US008328595B2

(12) United States Patent
Van Dan Elzen

(10) Patent No.: US 8,328,595 B2
(45) Date of Patent: Dec. 11, 2012

(54) YO-YO HAVING TWIST-ON RELEASABLE RIMS AND YO-YO HAVING TWIST-ON GEAR-LOCKED BODIES

(75) Inventor: Hans W. Van Dan Elzen, Chandler, AZ (US)

(73) Assignee: Bandai Co., Ltd., Taito-ku, Tokyo (JP)

( * ) Notice: Subject to any disclaimer, the term of this patent is extended or adjusted under 35 U.S.C. 154(b) by 75 days.

(21) Appl. No.: 12/797,792

(22) Filed: Jun. 10, 2010

(65) Prior Publication Data

US 2010/0317255 A1 Dec. 16, 2010

Related U.S. Application Data

(60) Provisional application No. 61/186,828, filed on Jun. 13, 2009, provisional application No. 61/261,862, filed on Nov. 17, 2009.

(51) Int. Cl.
*A63H 1/30* (2006.01)

(52) U.S. Cl. ..... 446/250; 446/247

(58) Field of Classification Search ..... 446/236, 446/247–254

See application file for complete search history.

(56) References Cited

U.S. PATENT DOCUMENTS

| | | | | |
|---|---|---|---|---|
| 3,444,644 | A * | 5/1969 | Sayegh | 446/250 |
| 3,624,958 | A | 12/1971 | Salayka | |
| 3,805,443 | A * | 4/1974 | Duncan, Jr. | 446/250 |
| 3,953,936 | A * | 5/1976 | Ennis | 446/250 |
| 4,130,962 | A * | 12/1978 | Ennis | 446/250 |
| 4,555,235 | A * | 11/1985 | Burroughs | 446/250 |
| 5,184,972 | A | 2/1993 | Tomberlin | |
| 6,004,183 | A * | 12/1999 | Dixon et al. | 446/250 |
| 6,080,035 | A | 6/2000 | Pekarsky et al. | |
| 6,113,456 | A * | 9/2000 | Hadzicki et al. | 446/250 |
| 6,206,749 | B1 * | 3/2001 | Bell | 446/250 |
| 6,354,905 | B1 * | 3/2002 | Haines et al. | 446/250 |

(Continued)

FOREIGN PATENT DOCUMENTS

DE 197 31 087 A1 2/1998

(Continued)

OTHER PUBLICATIONS

Office Action dated Aug. 22, 2011, issued in the corresponding Japanese Patent Application No. 2010-134441.

*Primary Examiner* — Gene Kim
*Assistant Examiner* — Urszula M Cegielnik
(74) *Attorney, Agent, or Firm* — Buchanan Ingersoll & Rooney PC

(57) ABSTRACT

The invention is an improved yo-yo that features two side assemblies that sandwich a center axle onto which the yo-yo's tether may be secured. According to a first embodiment, each of the side assemblies preferably includes a releasable, disk-shaped rim piece. By replacing one set of replaceable rim pieces with another, a user can quickly and easily change the yo-yo's shape, look and/or functionality. To remove a rim piece, one first removes a lock ring that is secured to the rim piece and blocks a number of openings that lead to grooves in a center-located hub. Next, one employs a twisting movement of the rim piece to cause a number of tabs attached to the rim piece to slide in the hub's grooves until the tabs are aligned with the openings. The rim piece can then be disengaged from the yo-yo.

11 Claims, 18 Drawing Sheets

U.S. PATENT DOCUMENTS

| | | | | |
|---|---|---|---|---|
| 6,579,142 | B1 | 6/2003 | Rehkemper et al. | |
| 6,599,165 | B1 * | 7/2003 | Van Dan Elzen | 446/250 |
| 6,896,576 | B1 | 5/2005 | VanKuiken | |
| 7,059,932 | B1 * | 6/2006 | Tobias et al. | 446/250 |
| 7,125,310 | B1 | 10/2006 | Van Dan Elzen | |
| 7,192,330 | B2 * | 3/2007 | Van Dan Elzen | 446/250 |
| 7,281,965 | B2 * | 10/2007 | Torres | 446/250 |
| 2001/0001087 | A1 * | 5/2001 | Ichii et al. | 446/250 |
| 2002/0102907 | A1 | 8/2002 | Osawa | |
| 2006/0094329 | A1 * | 5/2006 | Van Dan Elzen | 446/250 |
| 2007/0026762 | A1 | 2/2007 | McPhee | |
| 2011/0009029 | A1 * | 1/2011 | Van Dan Elzen et al. | 446/250 |

FOREIGN PATENT DOCUMENTS

| | | | |
|---|---|---|---|
| DE | 199 00 785 | A1 | 8/1999 |
| JP | 11-137859 | A | 5/1999 |
| JP | 2003-135859 | A | 5/2003 |
| WO | WO 00/050139 | A1 | 8/2000 |

* cited by examiner

YO-YO HAVING TWIST-ON RELEASABLE RIMS AND YO-YO HAVING TWIST-ON GEAR-LOCKED BODIES

This application claims the benefit of U.S. Provisional Application No. 61/186,828 filed on Jun. 13, 2009 and U.S. Provisional Application No. 61/261,862 filed on Nov. 17, 2009, and wherein said applications are hereby incorporated herein by reference.

BACKGROUND OF THE INVENTION

1. Field of the Invention

The invention is in the field of user-manipulated toys. More particularly, the invention is an apparatus in the form of a yo-yo that has two side portions that sandwich a center axle onto which the yo-yo's tether is secured. Each of said side portions preferably includes a releasable, disk-shaped rim member. By swapping one set of rim members with another having different characteristics, a user can change the yo-yo's size, shape, weight and/or rim material. This can affect the yo-yo's appearance and/or functionality. Removal of a rim member is preferably easy for a user to accomplish and involves removal of a resilient lock ring and then twisting/rotating the rim member until tabs extending from the rim member are allowed to exit from complementary grooves in a center hub, whereupon the rim member is then free to be removed from the side portion. The invention also relates to an apparatus in the form of a yo-yo that has two side portions connected together by a central axle to which the yo-yo's tether is secured. Each of said side portions preferably includes a replaceable hub portion and a replaceable body portion. Securement of a body portion to a hub portion preferably entails rotating the body portion relative to the hub portion whereupon tabs of the body portion are received within channels of the hub portion. Once the tabs are in place, a gear-type locking mechanism positionally secures said body portion relative to the hub portion.

2. Description of the Related Art

Most yo-yos are in the form of two disk-shaped side portions that are rigidly connected to each other by some form of axle structure. The side portions are usually of a unitary construction in which the rim member is in the form of a continuous outward extension of a hub. Typical materials for yo-yo side portions include plastic, metal or wood. The axle structure is secured to the center of both side portions and may be an assembly of multiple parts, or merely be in the form of a dowel or a riveted pin. In many modern yo-yos, the axle structure includes a center-located spool, bearing or other member that is secured to, and rotatable on, an elongated axle pin.

The axle structure also forms an anchor for one end of a string-type tether. An end-located loop portion of the tether is positioned so that it encircles a center portion of the axle structure. The free end of the tether is usually tied to create a second loop portion that can be placed about one of a user's fingers to thereby secure the yo-yo to the user's hand.

When the tether is wound about the axle structure and the yo-yo is released, or thrown, from a user's hand, the yo-yo will begin to rapidly spin as it moves away from the user's hand and the tether unwinds from the axle structure. Once the tether is fully unwound, the yo-yo may "sleep" at the end of the tether, whereby the yo-yo's side portions continue to spin without the tether rewinding on the axle structure. Once the yo-yo is sleeping, there are a number of tricks, such as "walk the dog," that a person can perform with the spinning yo-yo. A sleeping yo-yo is also often used to perform tricks that involve temporarily placing the spinning yo-yo onto a portion of the tether intermediate of the tether's two ends.

At the completion of most yo-yo tricks, the user will make a quick tug/jerk on the tether. This will result in a brief tightening of the tether, which is then automatically followed by a temporary slackening of the tether. Once the tether goes slack, the tether's twist will cause one or more portions of the tether located proximate the axle structure to move, and thereby contact, a spinning portion of the yo-yo. Once contact has occurred, the tether portion can become locked to a spinning portion of the yo-yo in a manner whereby rotation of the spinning portion of the yo-yo causes the tether to wind about the axle structure. Winding of the tether on the axle structure makes the yo-yo return to the user's hand.

Over the years, many different shapes have been employed for the yo-yo's side portions. Traditional yo-yos will usually feature substantially planar side portions that have a bulge in the area of the rim to provide an improved weight distribution that increases spin time and stability. Butterfly yo-yos feature side portions that are stretched outwardly, away from the center of the yo-yo, thereby increasing the width of the yo-yo and giving the yo-yo a butterfly shape when viewed in cross-section.

It is also known to use different materials for, or on, the rim member of each of a yo-yo's side portions. For example, while most yo-yos have rim members made of a hard plastic material, it is known to employ rubber either as the rim material, or in the form of an o-ring that is placed on the periphery of each of a yo-yo's side portions.

The different shapes and materials employed in a yo-yo's side portions not only make the yo-yo distinctive, they also affect the yo-yo's performance. For example, a user performing looping tricks with a yo-yo will usually prefer a traditionally shaped yo-yo that has substantially planar side portions. Such a shape is best at looping since the weight distribution is close to the tether's attachment point on the yo-yo, thereby enabling the yo-yo to flip over relatively easily during each loop. For yo-yo tricks in which the user attempts to catch the spinning yo-yo on a medial portion of the tether, a butterfly shaped yo-yo is preferred. The more widely spaced-apart side portions improve the yo-yo's stability whereby the yo-yo is less prone to tilt off the tether. Furthermore, the wider stance of a butterfly-shaped yo-yo facilitates a user being able to land the yo-yo on a medial portion of the tether.

The weight and aerodynamics of the yo-yo's side portions may also affect the yo-yo's ability to sleep for an extended period of time. It is well known that heavier yo-yos can potentially spin for a longer time since the greater weight of their spinning portions increases the yo-yo's rotational momentum. Furthermore, the aerodynamic drag of the yo-yo's spinning portion, a function of the shape and surface contour of the side portions, can affect sleep time since a lower drag allows a yo-yo to sleep longer.

The characteristics of a yo-yo's side portions can also affect the ability of the yo-yo to return on command. The ability for a yo-yo to return on command depends on the tether becoming locked to a spinning portion of the yo-yo. It is well known that a yo-yo's weight can affect a yo-yo's ability to return on command since high weight equates to higher rotational momentum. When the tether goes slack and engages a spinning portion of the yo-yo, the larger the yo-yo's rotational momentum, the larger the engagement force that is required to cause the tether to become locked to said spinning portion of the yo-yo. In other words, the friction generated by a simple glancing contact between the tether and a spinning portion of the yo-yo may be sufficient to cause a light yo-yo to return. However, for a heavier yo-yo, the same contact may only result in the tether sliding on said portion if the friction generated is insufficient to cause the tether to lock onto said spinning portion.

Moreover, the characteristics of the hub or central portion of the yo-yo's side portions can also greatly affect the yo-yo's performance. For example, the hub portion of a yo-yo's side portion will typically feature engagement enhancements on its surface that faces the tether. Furthermore, yo-yos have been made that include an auto-return mechanism in at least one of the yo-yo's hub portions. Said auto-return mechanism normally includes a plurality of centrifugally/centripetally-actuated members that can allow a portion of the axle assembly to freely rotate when the yo-yo is spinning rapidly, and then to be become locked to the side portions when the yo-yo slows down. Once locked, the yo-yo's tether will wrap about said axle portion and thereby cause the yo-yo to return to the user's hand.

To take advantage of the different yo-yo performance characteristics provided through the use of side portions of different shapes and/or materials and/or weights, or that have hub portions that include different features, many experienced yo-yo players will own a large variety of different yo-yos. This enables the player to pick a yo-yo from his or her collection that will work best for the particular trick(s) that the player wishes to perform. However, the costs involved in buying and maintaining a large number of yo-yos can be considerable. In addition, transporting a large number of yo-yos can be bothersome and is usually accomplished using a bulky and expensive transport case specially adapted for carrying yo-yos.

There have also been some prior art yo-yos that employed exchangeable hub portions and rims/body portions. However, said yo-yos have required the user to employ special tools to replace the hubs and rims/body portions and/or the rims/body portions are hard to remove and/or have required complex securement methods and/or lacked a sufficiently positive securement to maintain the hub portions and/or rims/body portions in place should the yo-yo hit a surface or object.

SUMMARY OF THE INVENTION

Like most other yo-yos, a yo-yo in accordance with the invention includes a central axle structure that connects together the yo-yo's two side portions in a spaced-apart relation. However, unlike most other yo-yos, a yo-yo in accordance with the invention has side portions that are an assemblage of parts and wherein each side portion includes a replaceable, disk-shaped rim member/body portion that is secured to a center hub or replaceable hub in a unique manner.

In one preferred embodiment, the replaceable rim member is secured to a peripherally-located portion of the hub. A lock ring is preferably secured to both the rim member and hub to lock the rim member to the hub. The lock ring is preferably made from a resilient, or semi-resilient, material. Once secured in place, the replaceable rim member at least partially defines the ultimate shape and weight of the side portion.

The yo-yo's replaceable rim members can be made of any material such as metal, plastic, wood or rubber. The rim members may be of any desired shape whereby the use of a particular set of rim members can cause the yo-yo to have a diablo-type shape, a conventional shape, a butterfly shape, or any other preferred yo-yo shape. In this manner, a user can replace one set of replaceable rim members with another and thereby quickly and easily change the yo-yo's shape and/or rim material and/or responsiveness. For example, the yo-yo can initially be set for looping whereby it features rim members that give the yo-yo's side portions a substantially planar configuration. To make the yo-yo ideal for string tricks, a user can quickly and easily remove said rim members and attach different rim members that convert the yo-yo into a butterfly shape. As another alternative, a user can replace a light-weight set of replaceable rim members with a set of rim members that are much heavier.

In another preferred embodiment, the yo-yo has two side portions that appear identical but each includes a different mechanism for securing the replaceable body portion to the replaceable hub. In one side portion, a gear arrangement that employs a plurality of spur gears is used to lock the body portion to the hub portion once said body portion has been rotated into a proper position on the hub portion. In the other side portion, a gear arrangement partially located in the side portion's outer lens is used to lock the body portion to the hub portion once said body portion has been rotated into a proper position on the hub portion. It should be noted that a yo-yo in accordance with the invention can alternatively employ identical side portions.

The yo-yo's replaceable body portions can be made of any material such as metal, plastic, wood or rubber and may even be a composite of said materials or an assembly of parts. Furthermore, the body portions may be of any desired shape whereby the use of a particular set of body portions can cause the yo-yo to have a traditional shape wherein both side portions are substantially planar disks, a butterfly shape, or any other preferred yo-yo shape. In this manner, a user can replace one set of replaceable body portions with another set and thereby quickly and easily change the yo-yo's shape and/or rim material and/or responsiveness. For example, the yo-yo can initially be set for looping whereby it features body portions that give the yo-yo's side portions a substantially planar configuration. To make the yo-yo ideal for string tricks, a user can quickly and easily remove said body portions and attach different body portions that convert the yo-yo into a butterfly shape. As another alternative, a user can replace a light-weight set of replaceable body portions with a set of body portions that are much heavier.

Furthermore, the body portions can optionally include a replaceable lens whereby a user can remove said lens, install a weight ring into the body portion, and then secure the lens back onto the body portion to thereby increase the weight of the yo-yo.

In addition, different hub portions may be employed. Available hub portions may include different features, including different locking mechanisms and/or they may include an auto-return mechanism.

The invention is therefore a yo-yo having side portions that can be easily modified by a user and that has rim members that are positively secured. Modification of the side portions enables the yo-yo to be optimized for different types of tricks, thereby enabling the yo-yo to effectively take the place of multiple yo-yos. This negates the need for the user to own, maintain and transport multiple yo-yos. In addition, a user modifiable yo-yo, as taught herein, can provide increased interest to a user through the yo-yo's extended range of usability and the player's ability to decide on the best manner in which to modify the yo-yo for the performance of particular tricks.

Further features of the present invention will become apparent from the following description of exemplary embodiments with reference to the attached drawings.

DESCRIPTION OF THE EMBODIMENTS

First Embodiment

Figure 1:
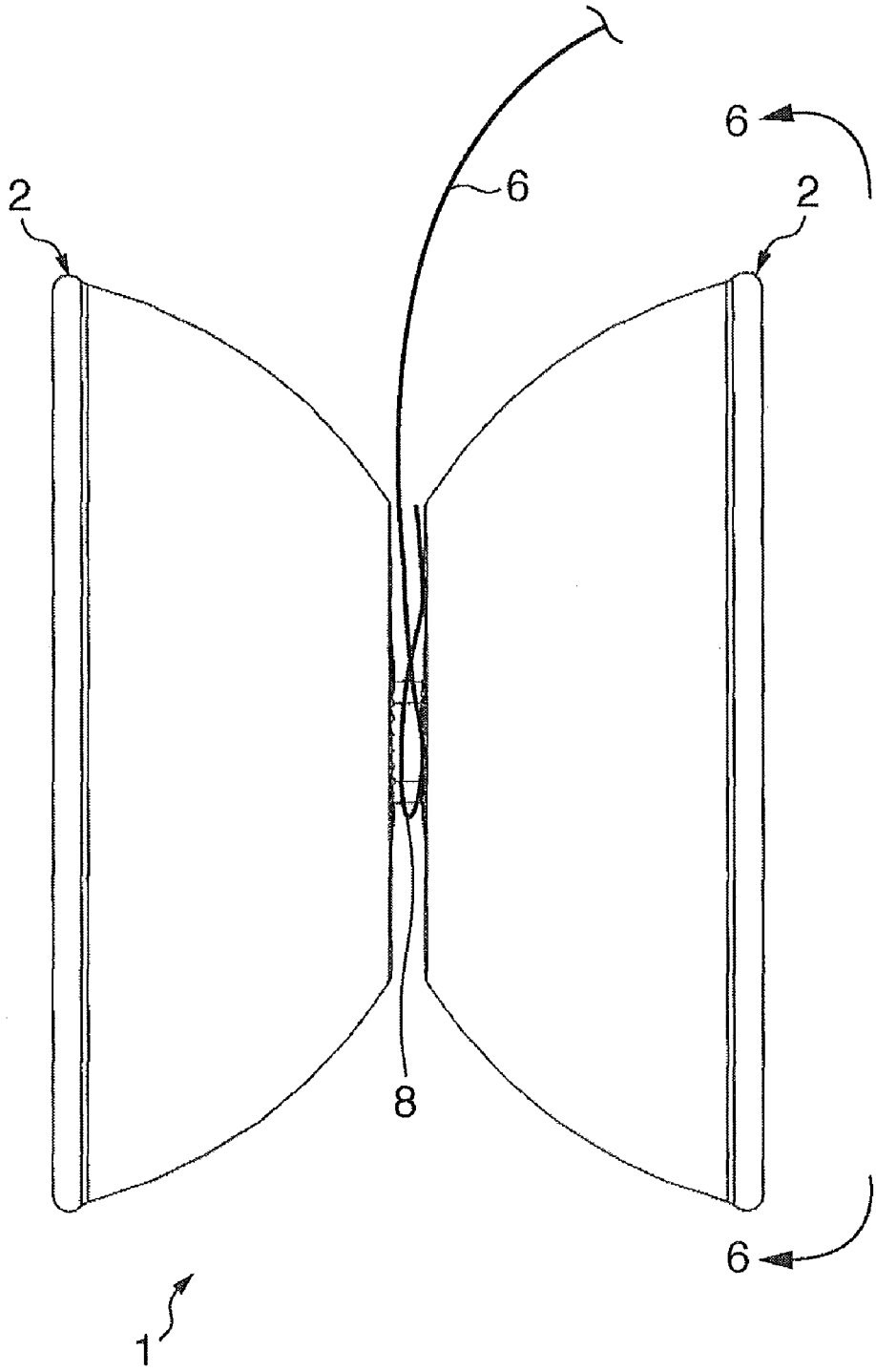
FIG. 1 is a front view of a yo-yo in accordance with a first embodiment of the invention.
Figure 2:
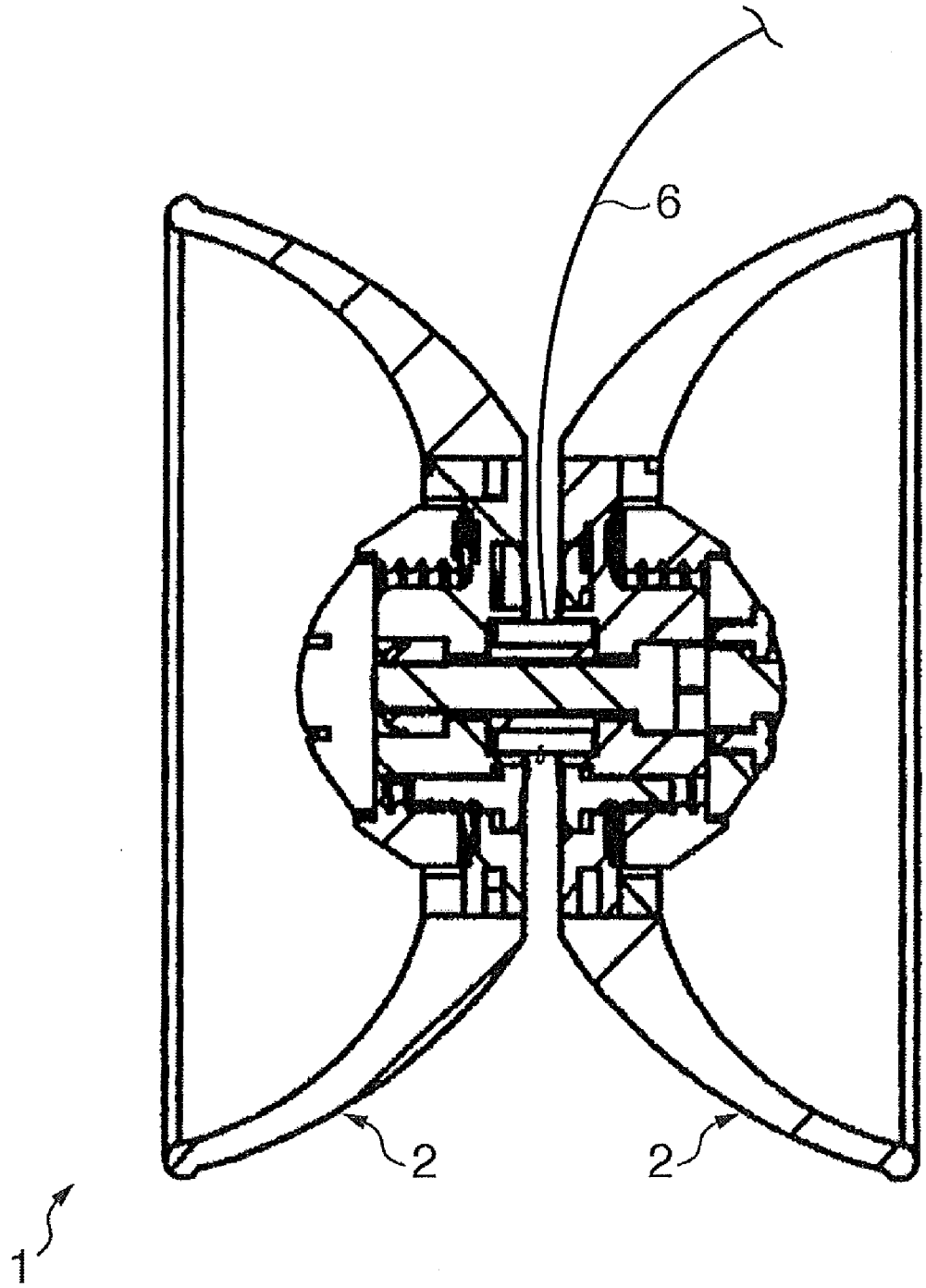
FIG. 2 is a cross-sectional view of the yo-yo shown in FIG. 1.
Figure 3:
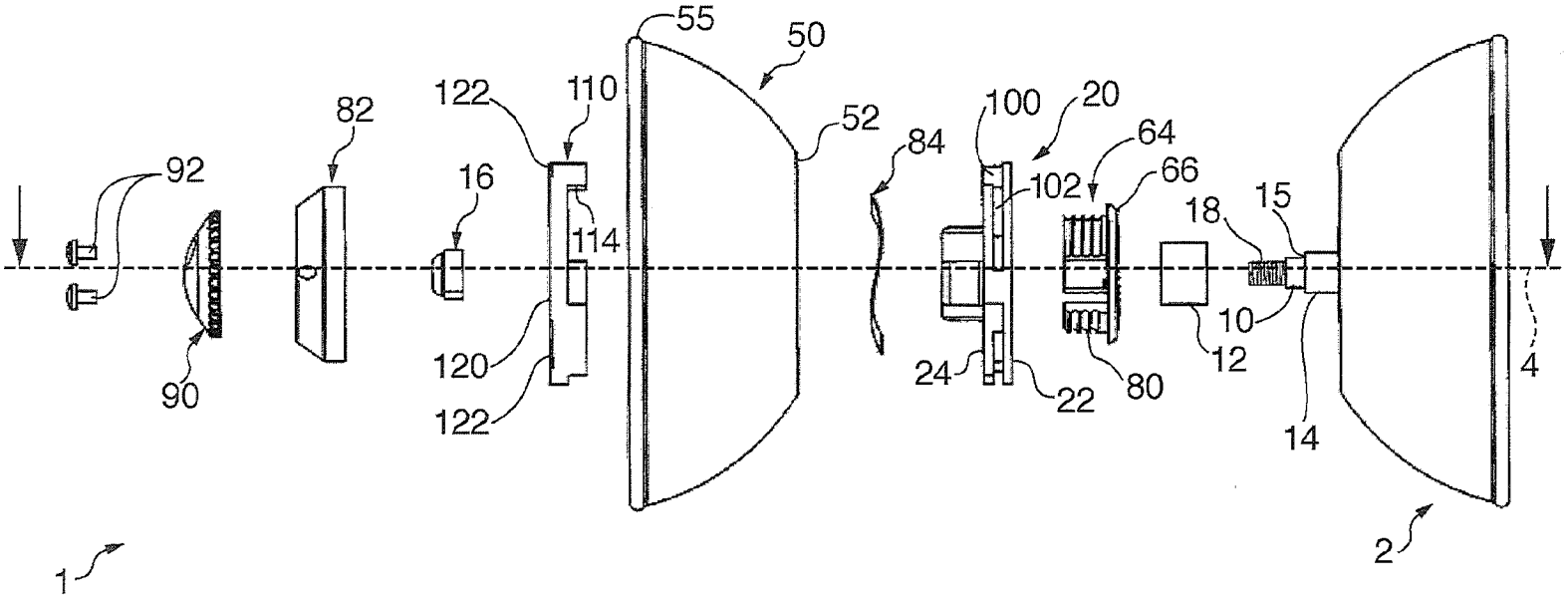
FIG. 3 is a front view of the yo-yo shown in FIG. 1, with the left-hand portion shown in exploded fashion.
Figure 4:
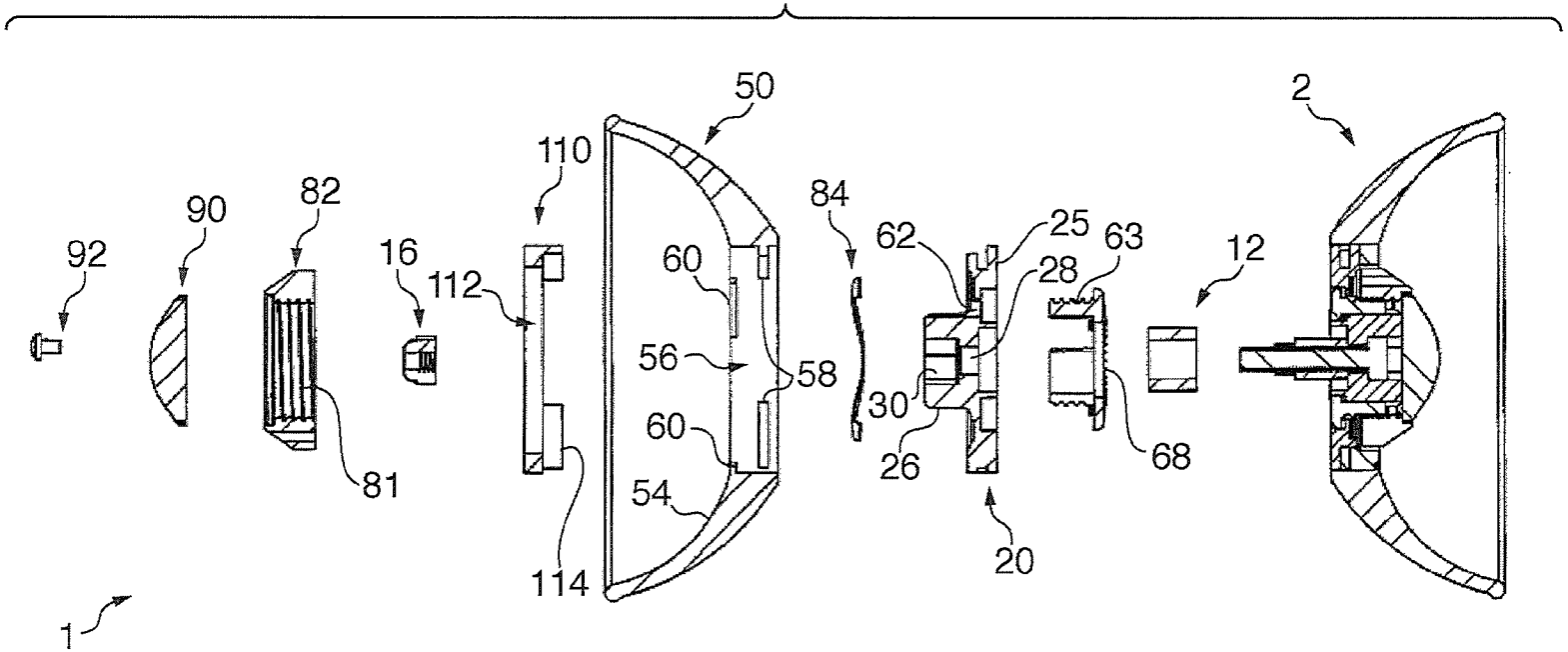
FIG. 4 is a cross-sectional view of the exploded yo-yo shown in FIG. 3, taken at the plane labeled 4-4 in FIG. 3.
Figure 5:
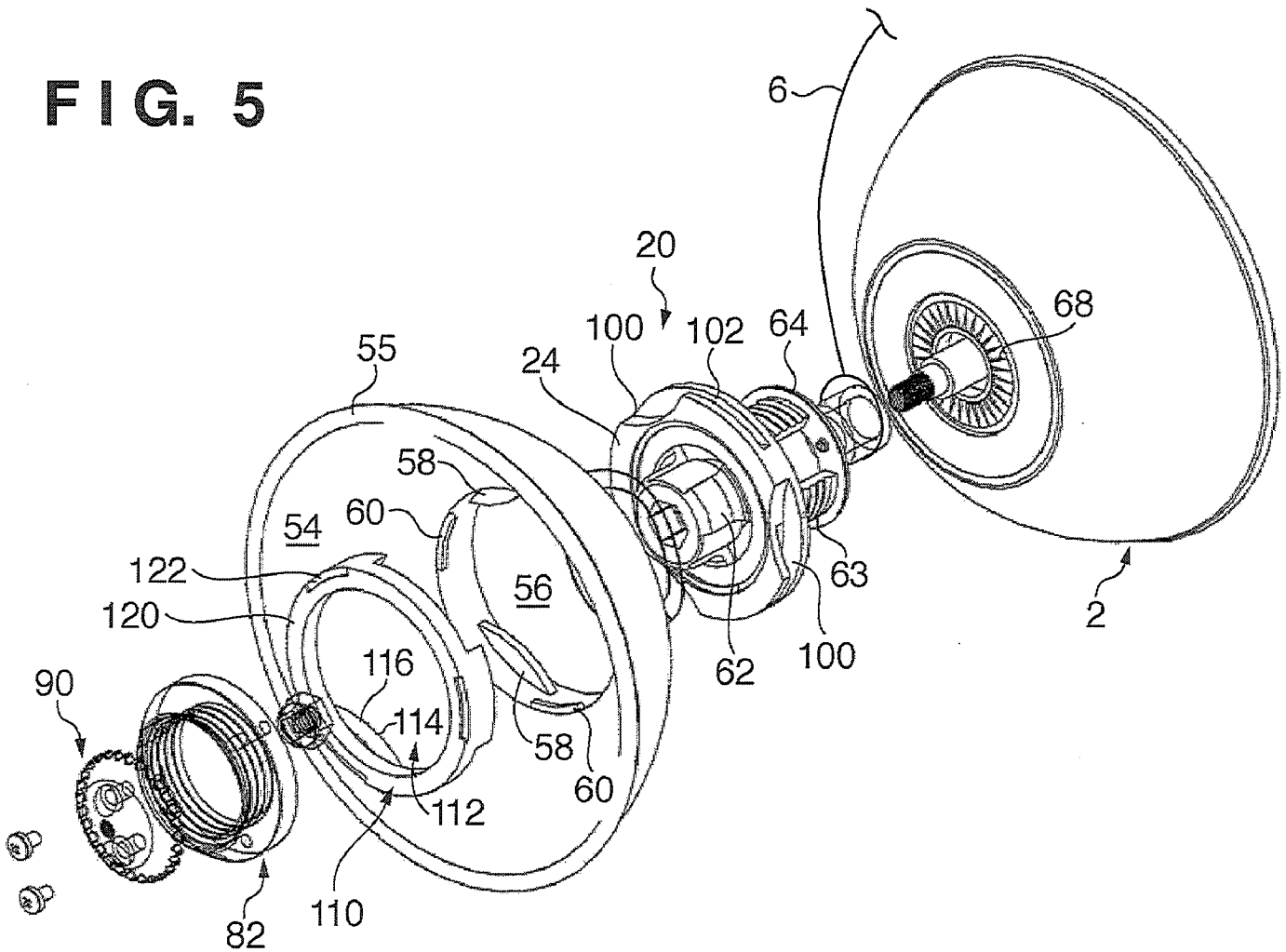
FIG. 5 is a perspective view of the yo-yo shown in FIG. 1, with the left-hand portion shown in exploded fashion.
Figure 6:
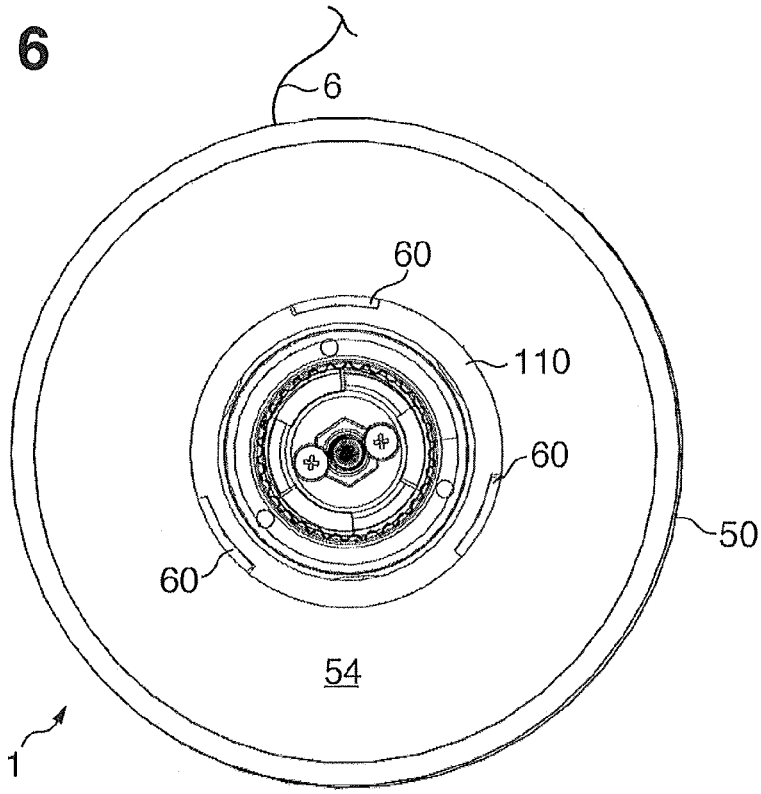
FIG. 6 is a side view of the yo-yo shown in FIG. 1, taken at the plane labeled 6-6 in FIG. 1.

Looking now to the FIGS. 1 to 7 in greater detail, wherein like reference numerals refer to like parts throughout the several figures, there is indicated by the numeral 1 a yo-yo in accordance with first embodiment of the invention.

The yo-yo 1 includes first and second side portions 2 that are preferably identical and are connected together via an axle structure 4. A string-type tether 6 includes a loop portion 8 that encircles a center portion of the axle structure. The tether's distal end (not shown) will normally be tied to create a loop to enable a temporary securement of said end to one of a user's fingers.

The axle structure 4 is preferably an assemblage of parts (note FIGS. 3 and 4) that includes an axle pin 10 and a rotatable spool 12. The axle pin has a longitudinal axis colinear with the yo-yo's axis of rotation. The spool is rotatably fitted on a large diameter tubular spacer 14 through which the axle pin extends. The spacer's shoulders 15 are designed and sized to contact the side portions and thereby maintain them in a spaced-apart condition. Each side portion includes a hex nut 16 that is designed to be threadedly engaged to exterior threads 18 located at each end of the axle pin to thereby secure together the yo-yo. It should be noted that other types of rotatable units or members can be used in lieu of the spool shown. Alternatively, the spool can be dispensed with when the yo-yo's tether is attached directly to the spacer, or to a structure fixedly secured to said pin, or to an equivalent structure that connects the side portions together.

Each side portion 2 includes a hub 20 that has an inwardly-facing surface 22, an outwardly-facing surface 24, a peripheral portion 25 and an outwardly-extending nipple portion 26. A thru-bore 28 extends through the center of the hub. Located in the peripheral portion 25 are a plurality of semi-circular cut-outs 100. Each of said cut-outs is in the form of a hole or discontinuity in one sidewall of an adjacent peripheral groove 102 in the hub. While a plurality of separate grooves 102 are shown, alternatively a single groove may be employed that extends completely about the perimeter of the hub, and wherein the openings form discontinuities in one of the groove's sidewalls.

Preferably, the hub 20 is made of a rigid, or substantially rigid, plastic material. Alternatively, the hub can be made of other materials, including metal, wood, hard rubber or be a composite or assemblage of rigid and/or non-rigid parts.

The hub's thru-bore 28 leads into a hexagonally-shaped cavity 30. Said cavity is designed to lockingly receive a hex nut 16. The hex nut is preferably sized to create an interference fit with the walls of cavity 30 and is preferably pressed into the hub. Alternatively, other shapes or types of nuts, or other methods for securing said nuts, such as the use of adhesives or sonic welding, may be employed.

Secured to the peripheral portion of each hub is a replaceable rim member 50. The rim member features an inwardly-facing surface 52, an outwardly-facing surface 54, a rounded peripheral area that forms the side portion's rim 55, and a center-located thru-hole 56. The thru-hole has a diameter greater than that of the hub's nipple portion 26. The replaceable rim member also includes at least one semi-circular securement tab 58 (note FIGS. 4 and 5) that extends into the area of the rim member's thru-hole. In the preferred embodiment, the rim member includes three of such tabs. Also extending into the rim member's thru-hole is at least one lock tab 60. In the preferred embodiment, three lock tabs are employed, with each offset from one of said securement tabs 58. While it is preferred that the rim member can have an equal number of securement tabs and lock tabs, an unequal number of securement and lock tabs may be employed.

Fitting through each of three apertures 62 in the hub is an arm 63 of a shuttle member 64. The tether-facing surface 66 of said shuttle member preferably includes a plurality of rib members 68 that extend toward the yo-yo's tether and can function to facilitate engagement between said tether and said side member when the yo-yo is sleeping and the user jerks his hand to cause the yo-yo to return to his hand. Other known types of surface adaptations that facilitate tether engagement in yo-yos, such as indentations, spaced pads/protrusions, the use of a material, such as rubber, that has a high coefficient of friction, may be used in conjunction with, or in place of, the rib members 68.

The arms 63 of the shuttle include threads 80 that can be engaged by interior threads 81 of a rotatable nut member 82. The nut member is free to rotate and is spaced from the hub by a wave washer 84. In this manner, rotation of the nut member by a user can cause the shuttle to move towards, or away from the tether and thereby affect how easy it is to cause the tether to engage said rib members 68 of the shuttle. The nut member is rotatably secured to the hub by a cap member 90 that is fixed to said hub by screws 92.

When a user is installing a rim member onto a bare hub, one that doesn't have an attached rim member, one orients the rim member so that the hub's nipple portion extends through the rim member's thru-hole 56. One then aligns the rim member's securement tabs 58 with the semi-circular cut-outs 100 in the hub.

The rim member is then positioned so that the securement tabs 58 enter into the cut-outs 100. A user then applies a twisting/rotational force on the rim member and moves said rim member relative to the hub whereby until each securement tab moves completely past the cut-out 100 and is fully received into one of said grooves 102. Preferably, each securement tab has a thickness approximately equal to, or just slightly smaller than, the width of a groove 102.

Next, the user installs a lock ring 110. The lock ring is preferably made of a semi-resilient or resilient material, such as rubber or a deformable plastic. The lock ring includes a center-located thru-hole 112 and has a plurality of semi-circular follower tabs 114 that extend into said thru-hole. These follower tabs have an identical size and shape as the securement tabs 58 of the rim member, but are preferably about twice as thick. Once the rim member has been twisted so that it is engaged to the hub, as already described, the lock ring is positioned so that its follower tabs 114 are received into said cut-outs 100. The follower tabs are preferably sized whereby once a tab 114 is received within a cutout 100, it fills the cut-out and blocks the groove 102 adjacent the cut-out. As the lock ring is pushed onto the hub, it must be slightly deformed to get past the rim member's lock tabs 60. When finally past the tabs 60, the rim member is allowed to return to its normal shape whereby said tabs 60 press on the lock ring's outwardly-facing surface 120 and are received into complementary depressions 122 in said surface. In this manner, the lock tabs 60 hold the lock ring in place in a non-rotatable manner.

While the replaceable rim members shown in the figures is a unitary part, said rim member may be an assembly that includes a separate peripheral portion that is bonded, or otherwise secured to, the rim member's central portion.

Concerning basic assembly of the yo-yo 1, the first step is to position the spool 12 on the center of the spacer 15 which itself is centered on the axle pin 10. Next, the side portions 2, preferably already fully assembled with the rim members attached to the hubs, are secured to the axle pin. This is accomplished by moving the side portions so that the ends of the axle pin enter each side-portion's hub's thru-bore and then is threadedly engaged to the locking hex nuts 16 located in each hub.

To remove a rim member 50 from a hub 20, one merely presses on the lock ring 110 until it disengages from the lock tabs 60. The lock ring can then be removed. The rim member is then twisted/rotated until the rim member's securement tabs 58 are fully centered in the cut-outs 100. The rim member can then slide off the hub and be removed.

Figure 7:
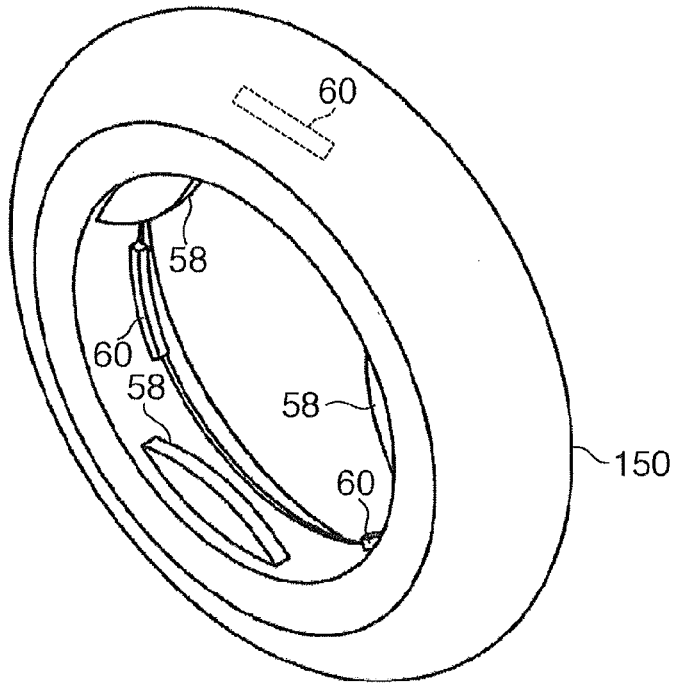
FIG. 7 is a perspective view of a rim member with an alternate shape in accordance with the first embodiment of the invention.
Figure 8:
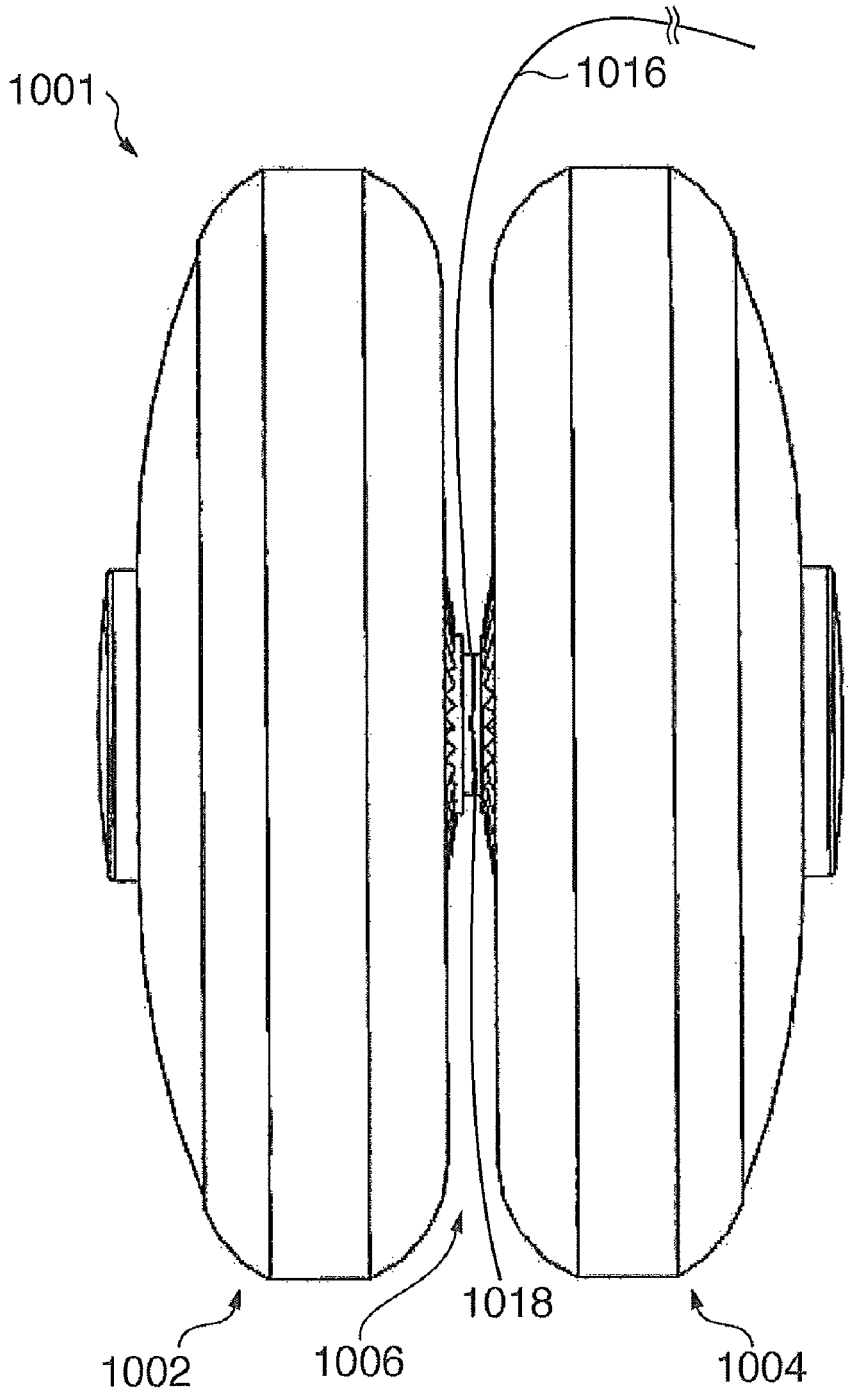
FIG. 8 is a front view of a yo-yo in accordance with a second embodiment of the invention.
Figure 9:
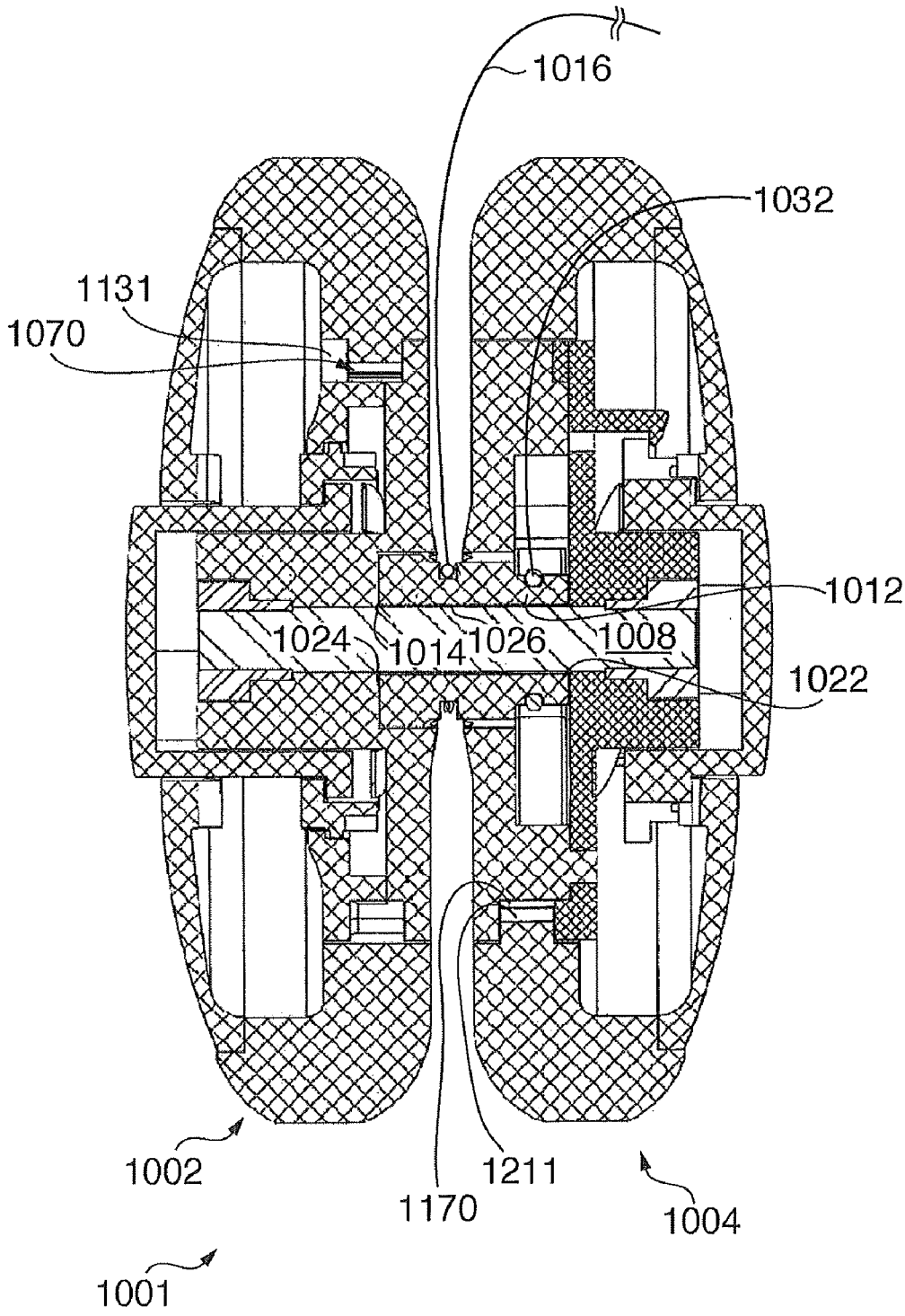
FIG. 9 is a cross-sectional view of the yo-yo shown in FIG. 8.
Figure 10:
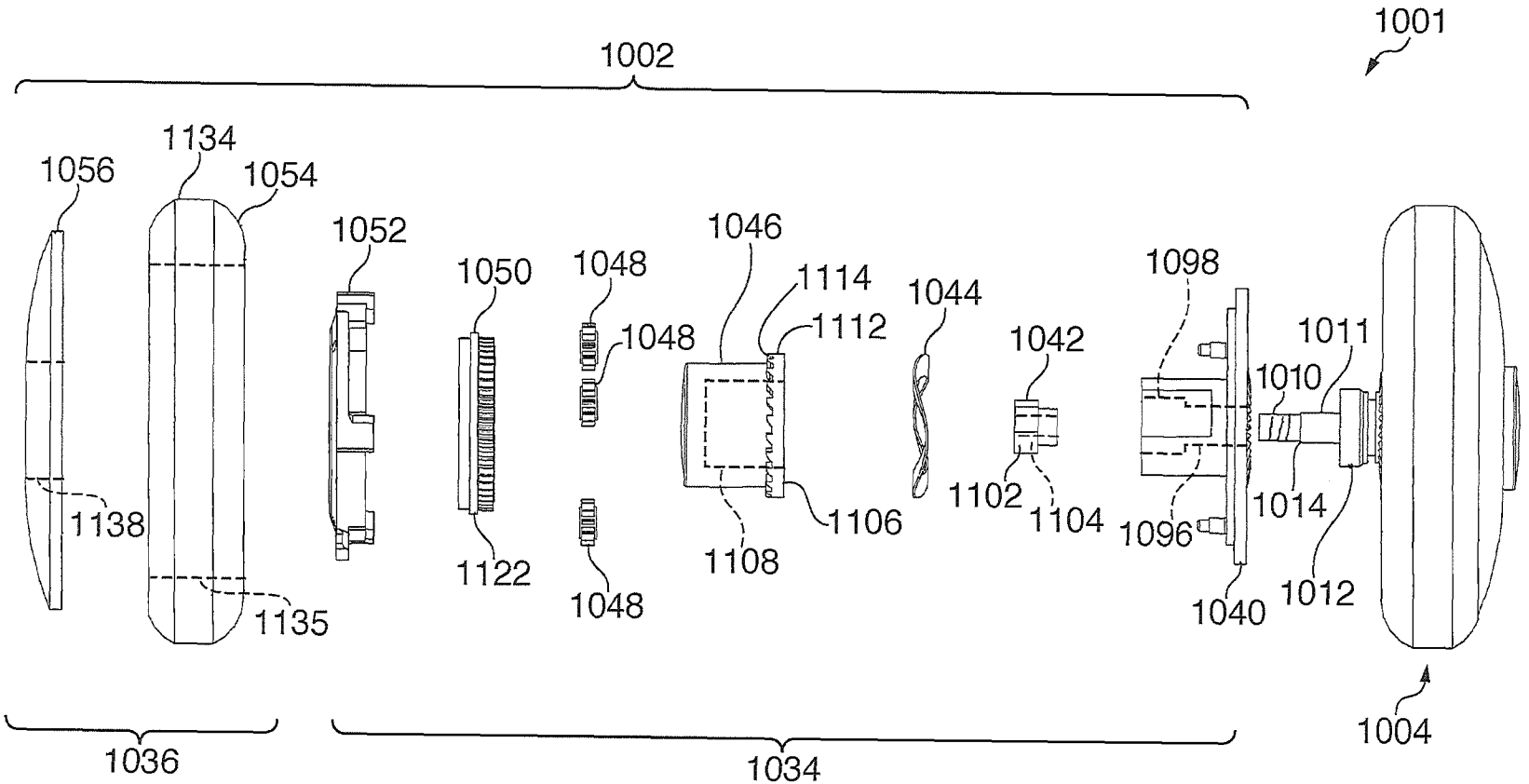
FIG. 10 is a front view of the yo-yo shown in FIG. 8, with the left-hand portion shown in exploded fashion.
Figure 11:
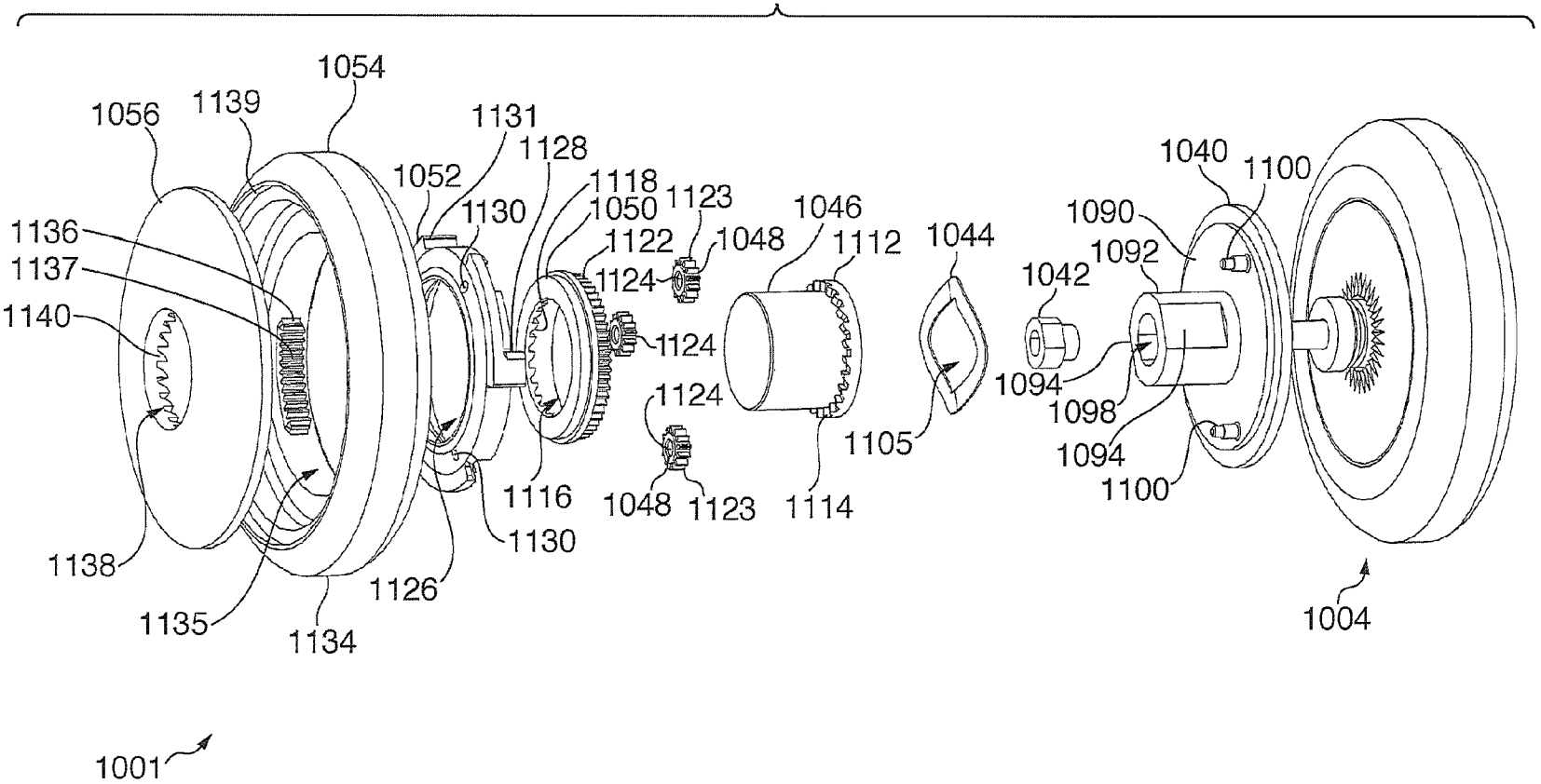
FIG. 11 is a first perspective view (approximately +30 degree rotation) of the exploded yo-yo shown in FIG. 10.
Figure 12:
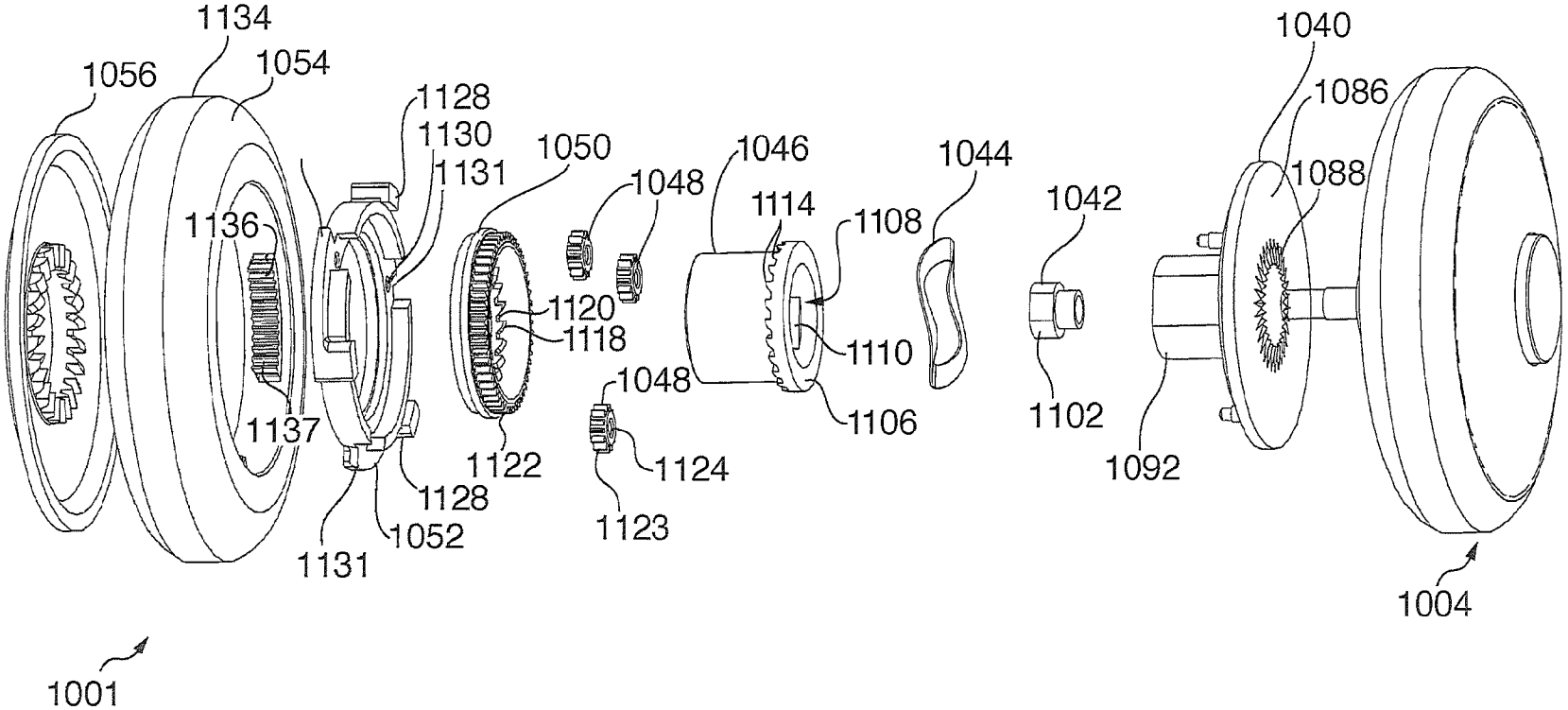
FIG. 12 is a second perspective view (approximately −30 degree rotation) of the exploded yo-yo shown in FIG. 10.
Figure 13:
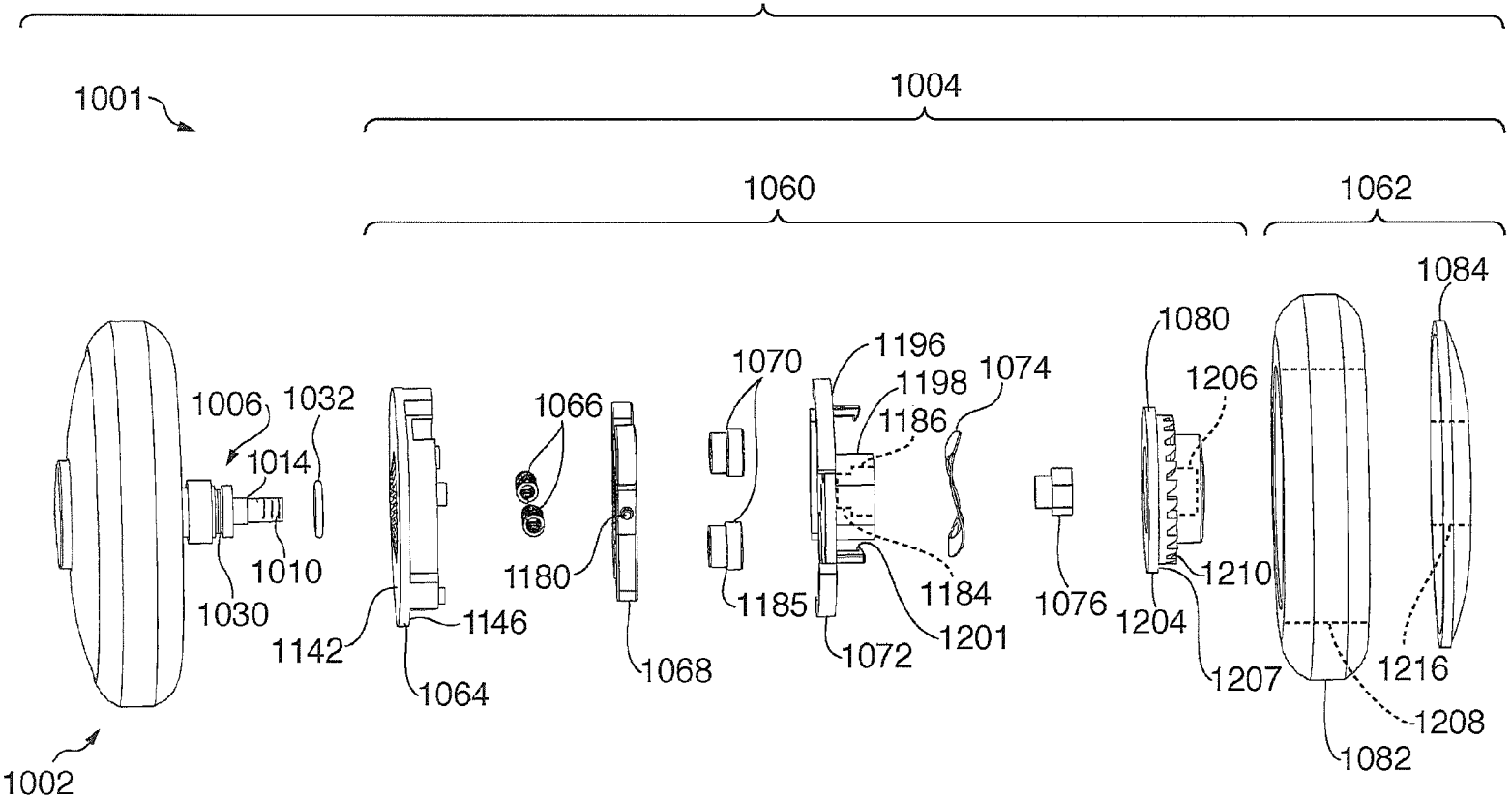
FIG. 13 is a front view of the yo-yo shown in FIG. 8, with the right-hand portion shown in exploded fashion.
Figure 14:
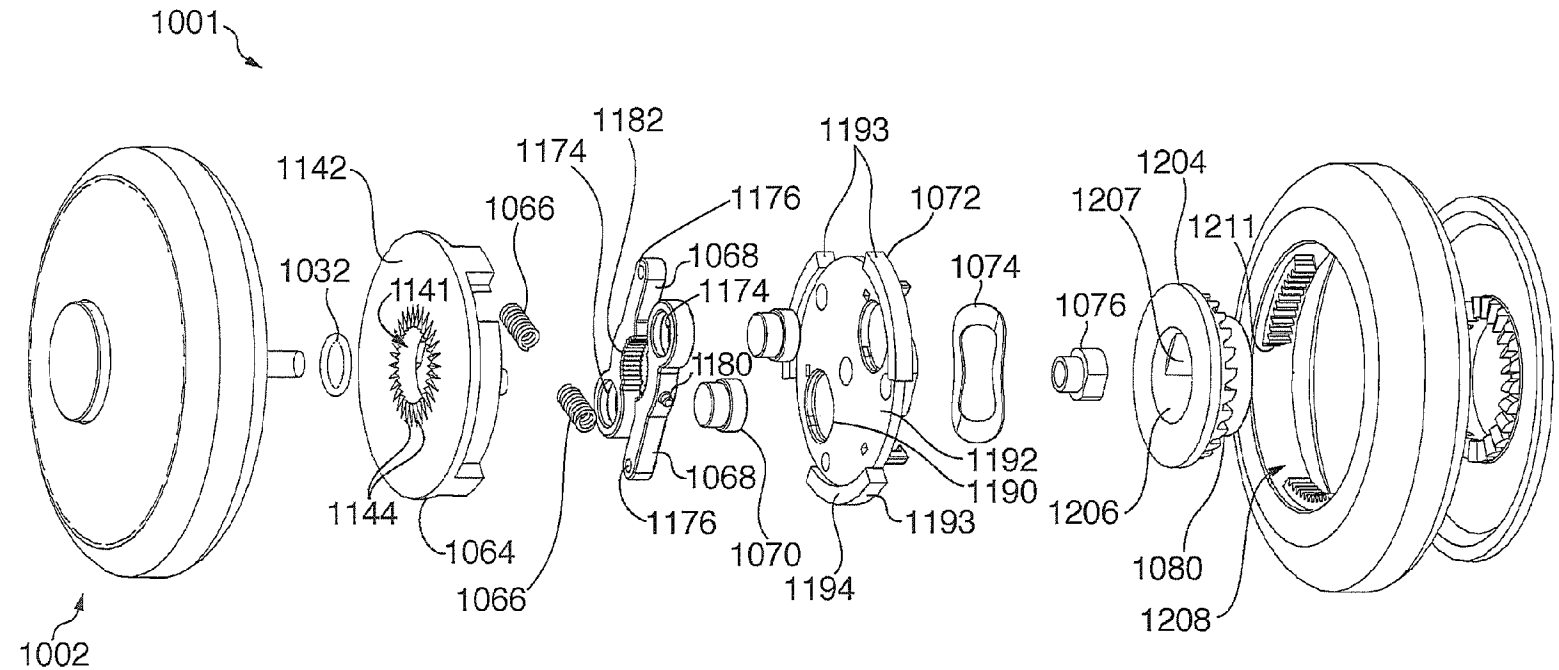
FIG. 14 is a first perspective view (approximately +30 degree rotation) of the exploded yo-yo shown in FIG. 13.
Figure 15:
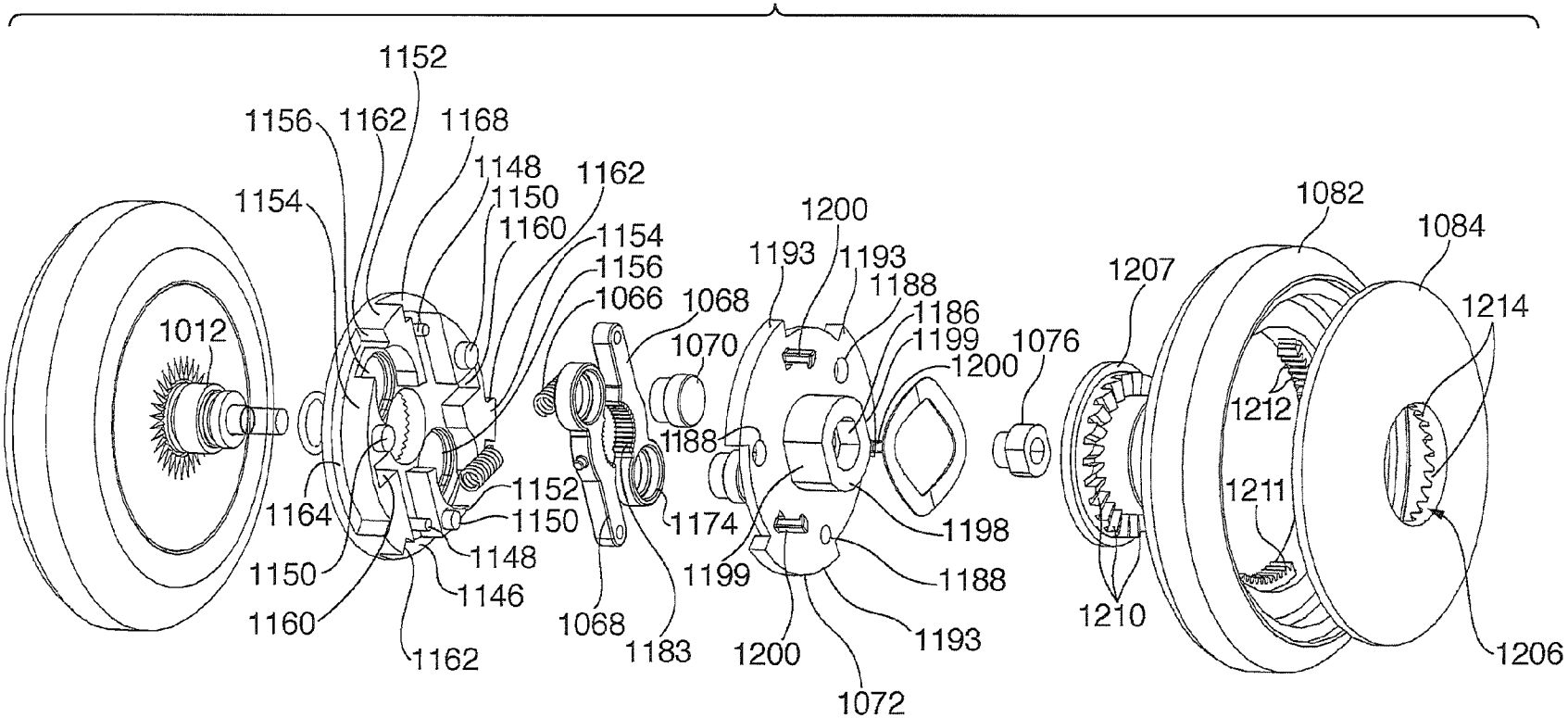
FIG. 15 is a second perspective view (approximately −30 degree rotation) of the exploded yo-yo shown in FIG. 13.
Figure 16:
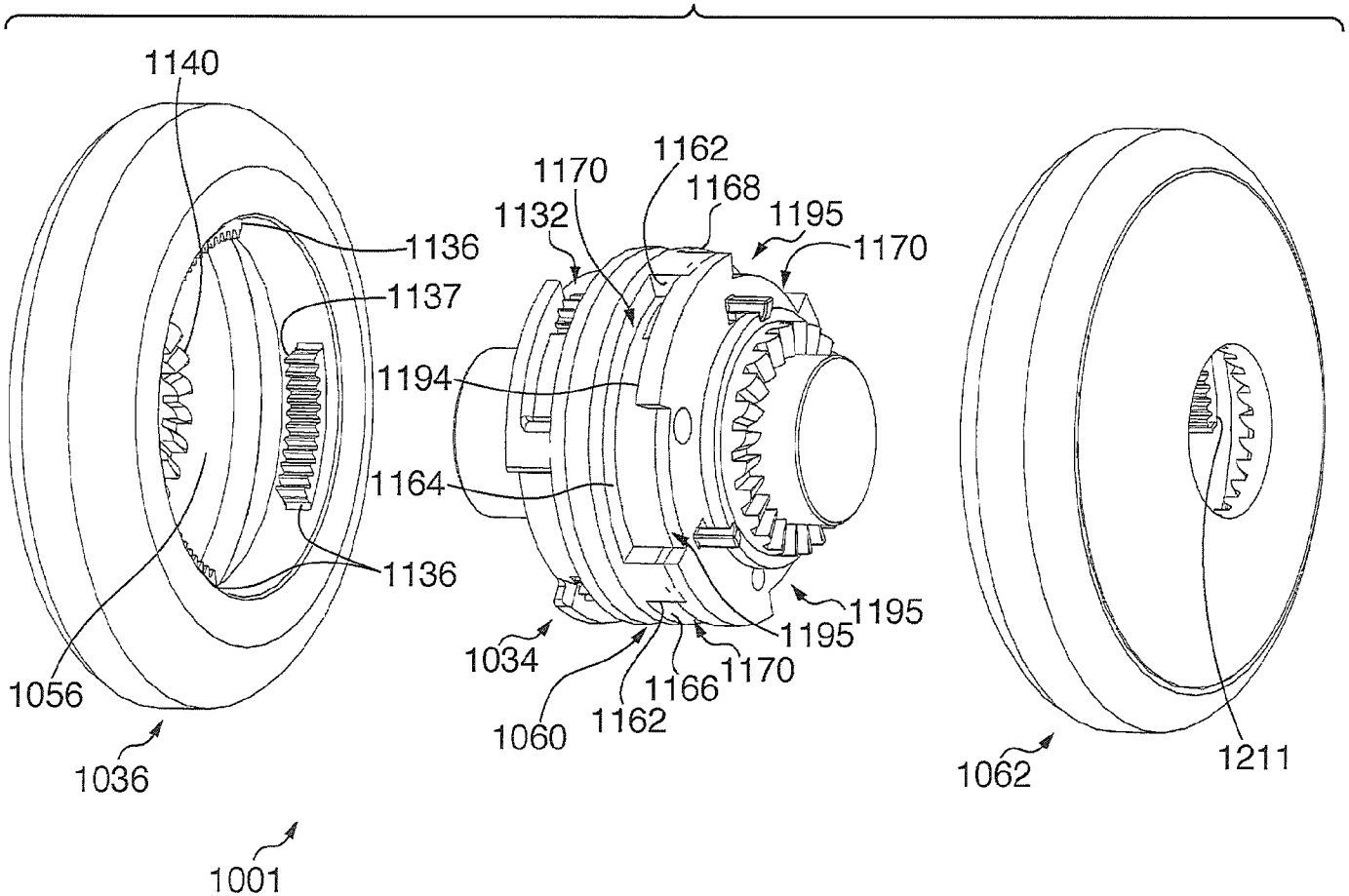
FIG. 16 is a first perspective view of the yo-yo shown in FIG. 8 wherein the yo-yo has been rotated approximately +30 degrees and the body portions have been disconnected from the hub portions.
Figure 17:
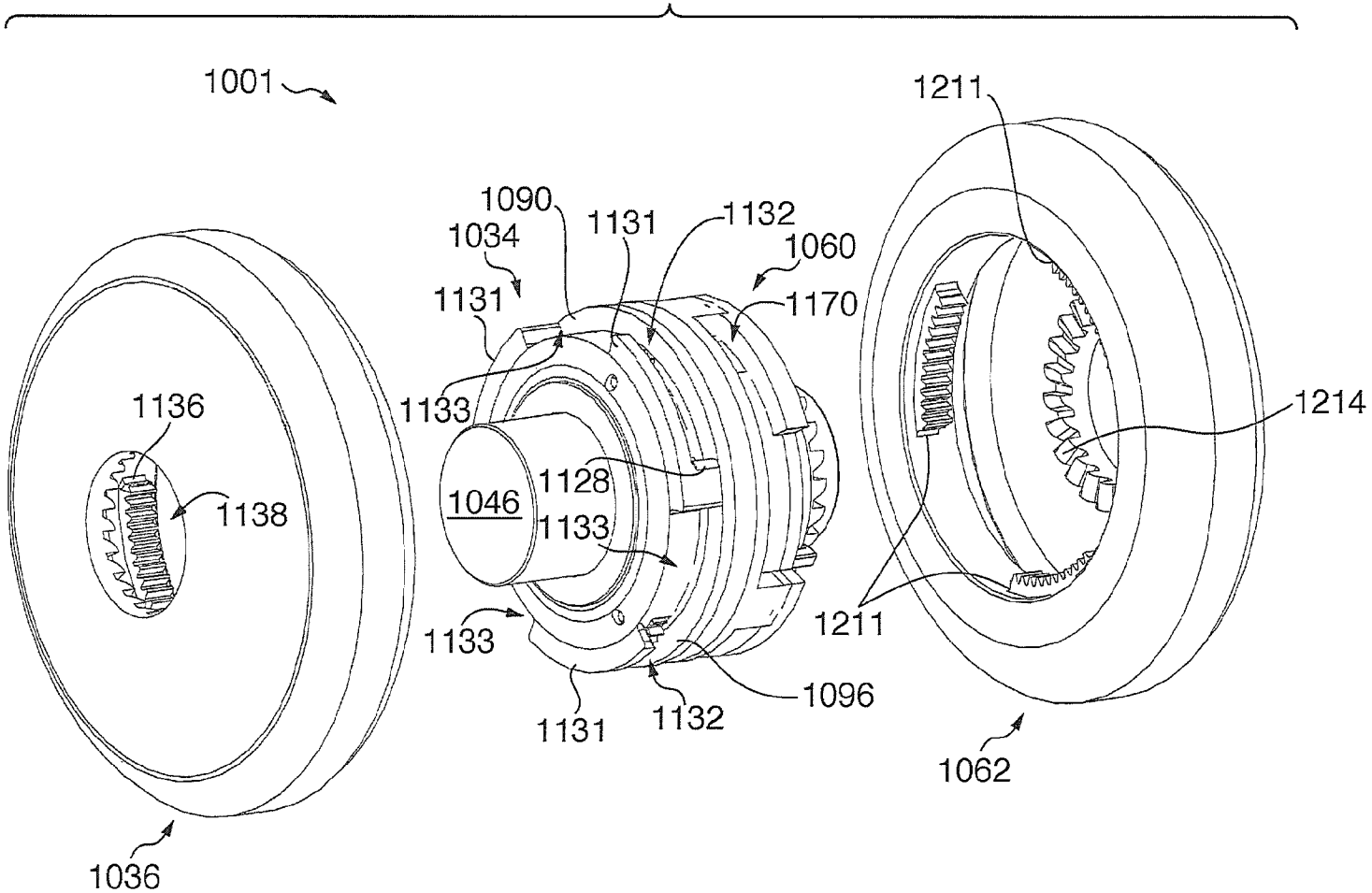
FIG. 17 is a view similar to FIG. 15 of the disassembled yo-yo shown in FIG. 8 but the perspective is taken at approximately a −30 degree rotation of the yo-yo.
Figure 18:
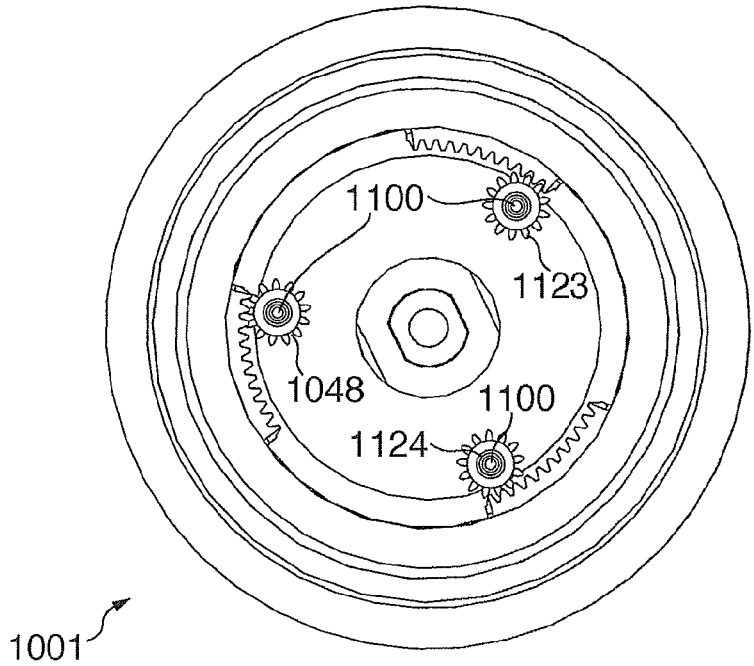
FIG. 18 is a left side view of the yo-yo shown in FIG. 8 with the lens, main gear, push button and spring removed.
Figure 19:
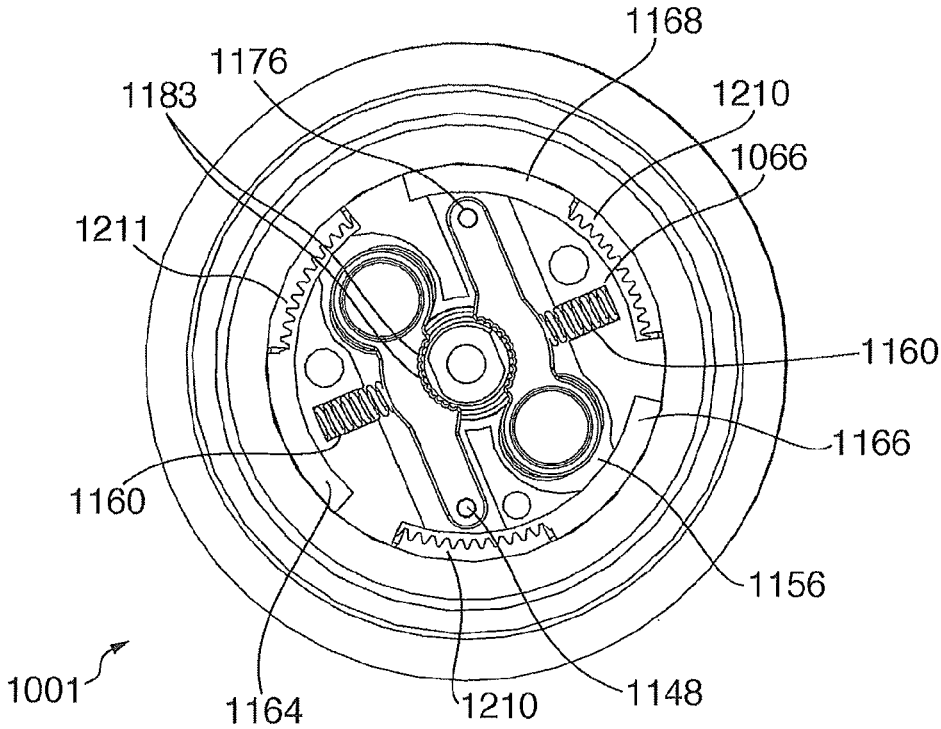
FIG. 19 is a right side view of the yo-yo shown in FIG. 8 with the lens, push button, spring and top plate removed.

It should be noted that the rim members may have other shapes than those described herein. FIG. 7 provides an example of an alternate shape for a rim member 150. In addition, while the yo-yo shown has a replaceable rim member in each of its side portions, it is within the scope of the invention whereby only one of the side portions may have a replaceable rim member, and the other side portion could be a unitary part or have a fixed rim member.

Second Embodiment

Looking now to the FIGS. 8 to 20 in greater detail, there is indicated by the numeral 1001 a yo-yo in accordance with second embodiment of the invention.

The yo-yo 1001 includes a first side portion 1002 and a second side portion 1004. The two side portions are connected together via an axle structure 1006. The axle structure is preferably an assemblage of parts and comprises an axle pin 1008 and spool 1012. The axle pin has exterior threads 1010 at each end and a longitudinal axis co-linear with the yo-yo's axis of rotation. The spool is rotatably located on a center portion 1011 of the axle pin. Since the axle pin's center portion 1011 has a greater diameter that the pin's ends, the pin includes two shoulders 1014 located where the pin's diameter changes. The shoulders 1014 are designed to contact said side portions and maintain them in a spaced-apart configuration. A string-type tether 1016 includes an end-located loop portion 1018 that encircles a center part of the spool. Said loop portion is preferably a double loop which will not slide on the surface of the spool. The tether's distal end (not shown) will normally be tied to create a loop to enable a temporary securement of said end to one of a user's fingers.

The spool 1012 is preferably substantially cylindrical in shape and has first and second ends, 1022 and 1024 respectively. The center of the spool includes a thru-bore 1026 through which the axle pin 8 extends. The diameter of bore 1026 is slightly greater than that of the center portion 1011 of the axle pin to thereby enable free rotation of the spool on the axle pin. In the preferred embodiment, the spool is made of a rigid material such as plastic or metal. The spool's interior surface that defines bore 1026 may be coated with a lubricating and/or low-friction material, such as TEFLON, grease or graphite.

Located on the exterior of the spool proximate the spool's end 1022 is a circumferentially-extending endless groove 1030. Located partially within said groove is an o-ring 1032 preferably made of a resilient material such as rubber.

Each of the yo-yo's side portions, 1002 and 1004, is an assemblage of parts. While in the preferred embodiment, the two side portions have different internal components, a yo-yo could be made that has an axle with identical side portions at each end. For example, a yo-yo in accordance with the second embodiment of the invention could have a side portion 1002 at each end of the axle, or alternatively, the axle could have a side portion 1004 at each end.

Side portion 1002 (note exploded views in FIGS. 10-12 and 16-17) includes a hub portion 1034 and a body portion 1036. The hub portion 1034 includes a hub 1040, a securement nut 1042, a spring 1044, a push button 1046, a plurality of spur gears 1048, a main gear 1050 and a top plate 1052. The body portion 1036 comprises a body 1054 and a lens 1056.

Side portion 1004 (note exploded views in FIGS. 13-17) includes a hub portion 1060 and a body portion 1062. The hub portion 1060 includes a hub 1064, a pair of springs 1066, two arms 1068, two weights 1070, a top plate 1072, a spring 1074, a securement nut 1076 and a push button 1080. The body portion 1062 is preferably identical to body portion 1036 and comprises a body 1082 and a lens 1084.

Hub 1040 is preferably made of a rigid material such as plastic or metal and has an inwardly-facing substantially planar surface 1086 that faces toward side portion 1004. Preferably, a starburst-shaped array of ribs 1088 extend out from said surface and functions to facilitate the tether being able to lockingly engage said surface when a user is trying to have the yo-yo return on command. Other known types of surface adaptations that facilitate tether engagement in yo-yos, such as indentations, spaced pads/protrusions, the use of a material, such as rubber, that has a high coefficient of friction, may be simultaneously employed in surface 1086 or used as an alternative to ribs 1088.

The hub also includes an outwardly-facing surface 1090 that faces away from side portion 1004 and surrounds a cylindrical nipple portion 1092. Located on opposite sides of the nipple portion are two flat side surfaces 1094. The hub has a thru-bore 1096 that extends through the nipple portion, has a diameter slightly greater than the diameter of the axle pin's center portion 1011 and includes a non-round expanded portion 1098 located at the distal end of the nipple portion. Extending outwardly from surface 1090 are three pin members 1100.

Fitting into area 1098 of the hub's nipple portion 1092 is the securement nut 1042. The exterior surface 1102 of the nut is non-round and is preferably complementary in shape to, and a tight fit in, area 1098 whereby once located in said area, the nut cannot be rotated relative to the hub. In the preferred embodiment, the nut 1042 may be pressed into, or molded with, area 1098, or sealed within area 1098 using a sonic welded cap. Other conventional methods of securing a nut may alternatively be employed. The interior of the nut includes a threaded thru-bore 1104 whereby said threads are complementary to the threads 1010 located on the end of the axle pin. While not shown, the nut will preferably have a nylon insert whereby said nut would function in the manner of a locknut.

Fitting about the base of the nipple portion 1092 is the spring 1044. Said spring has a center-located thru-hole 1105 and is preferably in the form of a metal or plastic wave washer. Other types of conventional springs, including a coil spring, may alternatively be employed.

Fitting over a distal end of the nipple portion 1092 is the push button 1046. Said push button is preferably made of a plastic or metal material. Located at the center of the inwardly-facing surface 1106 of the push button is an elongated bore 1108. The bore has a shape complementary to the end of the nipple portion, whereby said bore has two flat side surfaces 1110. When the push button is located on the nipple portion, said side surfaces 1110 will be located closely adjacent the nipple portion's side surfaces 1094 in a manner whereby said push button will be unable to rotate relative to the nipple portion. One should note that the push button includes a flange 1112 that extends in a direction perpendicular to a longitudinal axis of the button. Located on a top surface of said flange 1112 are a plurality of teeth 1114.

The push button is sized to partially fit through a center aperture 1116 in the main gear 1050. The main gear is preferably made of a rigid material such as plastic or metal and further includes a plurality of teeth 1118 arrayed in a ring and located in its inwardly-facing (toward the yo-yo's interior) surface 1120 proximate the aperture 1116. Said teeth are sized, shaped, spaced and angled whereby said teeth can engage teeth 1114 of the push button in a manner whereby once engaged and while the push button is allowed some longitudinal movement, the teeth will ride over each other when there is relative rotation between the push button and main gear in a first direction. The angle of teeth 1118 is such that they will lock with the teeth 1114 if there is any attempt of relative movement between the push button and main gear in a second direction opposite to said first direction. Located on the periphery of main gear 1050 is another ring of teeth 1122.

Teeth 1122 of the main gear are sized, shaped and spaced to engage the peripherally-located teeth 1123 of the three spur gears 1048. The spur gears are preferably made of a rigid material such as plastic or metal and each includes a central thru-bore 1124. Each of the spur gears is mounted on the hub 1040 via one of the hub's pin members 1100 fitting through the gear's thru-bore 1124 (note FIG. 18).

Located atop the main gear is the top plate 1052. The center of the top plate includes a thru-hole 1126 through which the push button extends. The plate includes three thru-bores 1130 sized and spaced to receive the ends of the pin members 1100 of the hub. In the preferred embodiment, when the hub portion is assembled, the top plate is properly aligned and positioned with the hub 1040 via the pin members 1100 fitting through the thru-bores 1130. Once so positioned, the top plate is secured to the hub via adhesive or sonic welding preferably in some, or all, of the areas where the hub and top plate contact each other. If sonic welding is employed, the spur gears 1048 would preferably be made of a different material than the hub or top plate to minimize any chance of said gears being damaged during the securement procedure. A non-permanent connection may alternatively be employed via a releasable snap-fit between the pin members 1100 and thru-bores 1130, or through the use of appropriate fasteners that secure to the pin members or to other portions of the hub 1040 and top plate 1052. Since thru-hole 1126 has a diameter less than the outer diameter of the main gear 1050, securement of the top plate to the hub captures and thereby secures the spur gears and the main gear. Securement of the main gear similarly captures and secures the push button 1046 and spring 1044 to the hub portion 1034.

It should be noted that the top plate has three peripherally-located semi-circular projections 1131. When the hub portion is assembled, there is a channel 1132 (note FIG. 17) in the form of a space between each of said projections 1131 and the outwardly-facing surface 1090 of the hub. At the end of each channel is a stop 1128 formed by a surface of the top plate. There are three cut-outs 1133 in the form of an open area (note FIG. 17) between each pair of projections 1131.

As noted previously, the body portion 1036 comprises a body 1054 and a lens 1056. The body 1054 is preferably round, disk-shaped and is preferably made of a rigid, or substantially rigid, material such as a hard plastic, metal or wood. Alternatively, the body can be made of other materials, including resilient or semi-resilient material such as various rubbers, or be a composite or assemblage of rigid and/or non-rigid parts. The periphery 1134 of the body forms the side portion's rim. Located at the center of the body is a thru-bore 1135. The body includes three tabs 1136 that extend into said thru-bore. While three tabs are shown, a greater or lesser number of tabs may be employed. Each of said tabs has a plurality of gear teeth 1137 on its distal/outer end.

Secured to the body is the lens 1056. The lens is preferably round and has a center thru-hole 1138 sized to enable the push button 1046 to extend therethrough. The lens is preferably releasably secured to the body via a snap-fit into recess 1139 in the body. Other methods for releasably connecting two members, such as a threaded engagement or fasteners, may alternatively be employed to connect the lens to the body. This releasable connection between the lens and the body allows a user to remove the lens from the body and insert an object, such as a weight ring (similar to a washer) into the interior of the body if said user wishes to increase the final weight of side portion 1002. While the lens is shown having teeth 1140 located proximate the lens' thru-hole 1138, said teeth are optional and are included merely to make lens 1056 identical to lens 1084 of side portion 1004. The lens may alternatively be permanently connected to the body via a sonic welding process, glue or any other method for permanently securing together two members.

Side portion 1004 will now be described. As noted previously, side portion 1004 includes a hub portion 1060 that features a hub 1064. Hub 1064 is preferably made of a rigid material such as plastic or metal and has a center-located thru-bore 1141 and an inwardly-facing substantially planar surface 1142 that faces toward side portion 1002. Preferably, a starburst-shaped array of ribs 1144 extend out from said surface and function to facilitate the tether being able to lockingly engage said surface when a user is trying to have the yo-yo return on command. The hub also includes an outwardly-facing surface 1146 that faces away from side portion 1002 and includes two outwardly-extending pins 1148, three cylindrical pins 1150, two small raised areas 1152, two large raised areas 1154, two oblong grooves 1156 and two relatively narrow grooves 1160. Surfaces 1164, 1166 and 1168 (note FIG. 16) will function as sidewalls to channels 1170 formed when the top plate 1072 is secured to the hub 1064. The raised areas create three stops 1162 in the form of flat surfaces that define the ends of said channels.

Each of the two arms 1068 is an elongated member made of a rigid material such as metal or plastic. Located at one end of each arm is a circular opening 1174 designed to receive one of the weights 1070 in a secure and fixed manner. Located at the opposite end of each arm is a thru-bore 1176 sized to be complementary to, but slightly greater in diameter than, the pins 1148 of the hub (note FIGS. 15 and 19). When the arms are positioned on the hub with the pins 1148 extending through the thru-bores 1176, the arms can pivot as the end of each arm that has one of the weights 1070 moves adjacent the oblong grooves 1156 in the hub. It should be noted that located at a medial point in each arm is a pin 1180 designed to be received within one end of a spring 1066. When the side portion is assembled, the springs will be captured within the grooves 1160 in the hub. Located on the opposite side of each arm from the pin 1180 is a concave surface 1182 that features a plurality of teeth 1183 and is complementary in shape to the spool's o-ring 1032. When the side portion is assembled, said teeth will be located whereby they can engage said o-ring 1032.

Each of the springs 1066 is a coil spring that is preferably made of a metal or plastic material. Like other coil springs, the springs 1066 have a circular opening at each end.

Each of the weights 1070 is preferably made of a metal material and is cylindrical in shape. To facilitate securement, the side surface of each weight includes a step 1185 designed to mate with a complementary interior surface of one of the arm's openings 1174.

Located outwardly of the arms 1068 is top plate 1072. The top plate has a center thru-bore 1184 that has a diameter greater than that of the axle pin. In this manner, when assembling the yo-yo, the axle pin's shoulder 1014 will contact the securement nut 1076 and limit the inward travel of side portion 1004 on the axle pin. One should note that the outer portion 1186 of the thru-bore 1184 has an increased diameter and non-round contour. The top plate also includes three small thru-bores 1188. Each of said thru-bores 1188 has a diameter complementary to the outer diameter of the hub's pins 1150. When the hub portion is assembled, the pins 1150 fit through the thru-bores 1188 to align and properly position the top plate on the hub.

One should note that the top plate includes two oblong grooves 1190 in the inwardly-facing surface 1192 of the top plate. When the top plate is secured to the hub, the weights 1070 will be partially located within, or be adjacent to, said grooves.

One should also note that located at the periphery of the top plate are three semi-circular projections 1193. The inwardly-facing surface 1194 of each of these areas will form a sidewall of a channel 1170 formed when the top plate is secured to the hub. On said hub, surfaces 1164, 1166 and 1168 form the opposite sidewall of said channels. Between each pair of projections 1193 is a cut-out 1195 which is an open area through which a body's tab 1211 can pass prior to entering one of the channels 1170 (note FIG. 17).

Located on the outwardly-facing surface 1196 of the top plate is an outwardly-extending nipple portion 1198. The nipple portion has a non-round body wherein a flat surface 1199 is located on opposite sides of the nipple portion. Also located on surface 1196 are three hooks 1200. Each of said hooks is preferably thin enough to be slightly flexible and has an 'L'-shaped end 1201.

Fitted within portion 1186 of the top plate's thru-bore 1184 is a securement nut 1076 that is preferably identical to securement nut 1042 and has a threaded center thru-bore 1202. The outer surface of said nut is preferably complementary to the non-circular contour of portion 1186 whereby when said nut is within portion 1186, said nut cannot be rotated relative to the top plate. In the preferred embodiment, the nut 1076 may be pressed into, or be molded with, portion 1186 or be sealed within portion 1186 using a sonic welded cap. Other conventional methods of securing a nut may alternatively be employed. While not shown, the nut will preferably have a nylon insert whereby said nut would function in the manner of a locknut. When assembling the yo-yo, the nut's interior threads will threadedly engage the axle pin's threads 1010.

Non-rotatably located on the nipple portion 1198 is the push button 1080. Said push button includes a flange portion 1204 and a non-circular center bore 1206 that has two opposing flat surfaces 1207. The shape of the center-bore is complementary to the contour of the non-round outer surface of the nipple portion 1198 whereby when the hub portion is assembled, surfaces 1207 will be located closely adjacent surfaces 1199 of the nipple portion and said push button will be incapable of rotating relative to the nipple portion. Located on the push button's flange portion and facing outwardly is a ring of gear teeth 1210.

It should be noted that sandwiched between the push button 1080 and top plate 1072 is a spring 1074. Preferably, the spring is identical to spring 1044 and is made of a flexible metal or plastic material and is in the form of a wave washer. Other forms of spring, such as a coil spring, may be alternatively employed.

When the push button 1080 is being secured to the top plate, the spring 1074 is placed on the nipple portion 198 and then said nipple portion is inserted into the push button's center bore 1206 with surfaces 1199 and 1207 aligned. Next, the push button is pressed onto the nipple portion to a point where the push button's flange portion 1204 contacts the ends 1201 of the hooks 1200. The push button is then moved further on the nipple portion whereby the hooks 1200 move outwardly and then, once the ends of the hooks are past the flange portion, the hooks spring back and their ends 1201 engage the outer surface 1207 of the flange portion. In this manner, the hooks hold the push button onto the top plate 1072, while the spring 1074 biases the push button in an outward direction away from the top plate.

When the hub portion is fully assembled and the hub and top plate are properly positioned by the hub's pins 1150 fitting into the top plate's thru-bores 1188, the hub and top plate are preferably secured together via a permanent securement method such as sonic welding or an adhesive. Alternatively, the hub and top plate can be releasably engaged via a snap-fit engagement between the pins 1150 and thru-bores 1188 or through the use of fasteners (not shown).

The body portion 1062 of side portion 1004 includes the body 1082 and lens 1084. Said body 1082 is preferably identical to body 1054 of side portion 1002 wherein it includes a center-located thru-bore 1208. The body has three tabs 1211 (note FIG. 17) that have teeth 1212. Said teeth 1212 are optional since this side portion does not use an identical fastening method to that employed in side portion 1002.

Secured to body 1082 is the lens 1084. Lens 1084 is preferably identical to lens 1056 and is secured to the body 1082 preferably in the same manner as employed for securing lens 1056 to body 1054. Lens 1084 includes a ring of teeth 1214 surrounding its center aperture 1216 through which the push button will extend when the side portion is fully assembled. While it was noted that teeth 1140 were not required in lens 1056, teeth 1214 are employed in side portion 1004 to engage teeth 1210 of the push button. It should be noted that the teeth 1214 and teeth 1210 are shaped, sized and angled whereby if said teeth 1214 and 1210 are engaging each other, teeth 1214 will ride over teeth 1210 when the body portion is rotated in a first direction relative to the hub portion and the push button is allowed to move longitudinally by slightly compressing spring 1074. However, the angling of teeth 1210 and 1214 will cause said teeth to lock together if one tries to rotate the body portion relative to the hub portion in a second, opposite direction. When the yo-yo is assembled and the push button 1080 is pressed in by a user, said push button will compress the spring 1074 and be moved to an extent so that teeth 1214 will not contact teeth 1210 whereby said body portion will thereby be allowed to rotate relative to the hub portion in said second direction.

To assemble a yo-yo 1001, the o-ring 1032 is placed in the spool's groove 1030 and the spool 1012 is placed on the center portion 1011 of the axle pin 1008, with said axle pin extending through the spool's thru-bore 1026. Next, a fully assembled hub portion 1034 is placed onto one end of the axle pin and rotated, whereby the threads 1011 of the axle pin engage the interior threads of nut 1042. One would continue to rotate the hub portion until the shoulder 1014 of the axle pin contacts the nut 1042.

Next, a fully assembled body portion 1036 is secured to the hub portion 1034. One orients the body portion so that the push button 1046 extends through the thru-hole 1138 in the body portion's lens 1056. At the same time, one moves the body's tabs 1136 through the cut-outs 1133 in the hub portion until said tabs are pressing on the periphery of the hub's surface 1090. The user then applies a twisting/rotational force on the body portion and moves said body portion relative to the hub portion in a direction whereby tabs 1136 move into the channels 1132. The body portion is rotated until each of said tabs 1136 moves completely past the cut-out 1133 and is fully received into one of said channels 1132. Preferably, each tab has a thickness that is slightly less than the width of a channel 1132.

It should be noted that as the user rotated the body portion relative to the hub portion, the tab's teeth 1137 engaged the teeth 1123 of the spur gears 1048 and caused said spur gears to rotate. As the spur gears rotated, their teeth 1123 also engaged teeth 1122 of the main gear and caused said main gear to also rotate. Due to the angling of the teeth 1114 of the push button and the main gear's teeth 118 engaging the push button's teeth 1114, the push button's teeth did not stop the main gear from rotating. Instead, the push button moved slightly back and forth via a compression of spring 1044. In this manner, a clicking sound would be made as the teeth 1118 of the main gear rode on the teeth 1114 of the push button as the body portion was rotated. Rotation of the body portion is continued until the body's tabs 1136 contact the stops 1128 in the top plate 1052. At this point, the body portion is fully installed on the hub portion. It should be noted that due to the angling of the teeth 1114 of the push button, said teeth will only allow the main gear's teeth 1118 to travel in one direction. Teeth 1114 stop any movement of teeth 1118 in the opposite direction, thereby preventing the body portion from an inadvertent rotation in the opposite direction whereby it could disengage from the hub portion.

Removal of body portion 1036 from hub portion 1034 is extremely quick and easy. A user merely presses in the push button 1046 until the push button's teeth 1114 disengage from the teeth 1118 of the main gear. Once disengaged, a user is free to rotate the body portion whereby the tabs 1136 move away from the stops 1128 to a position where said tabs are centered in the cut-outs 1133. The body portion is then free to be removed from the hub portion.

Side portion 1004 of the yo-yo 1001 may be connected to the axle pin 1008 either prior to, or after, the body portion 1036 was connected to the hub portion 1034.

To secure a fully assembled hub portion 1060 to the axle pin 1008, a user places the end of the axle pin into the thru-bore 1141 of the hub 1064 until the pin's outer threads 1011 engage the threads of the nut 1076 located within the top plate 1072. The hub portion 1060 is rotated until the axle pin's shoulder 1014 contacts the nut 1076. The hub portion is now secured to the axle pin.

The body portion 1062 may now be secured to the hub portion 1060 by placing the end of the push button 1080 through the aperture 1216 in the body portion's lens 1084. At the same time, one moves the body's tabs 1211 through the cut-outs 1195 in the hub portion. Once the tabs are pressing on the hub's surfaces 1164, 1166 and 1168, the user then applies a twisting/rotational force on the body portion and moves said body portion relative to the hub portion until each of said tabs 1211 moves into one of said channels 1170 and contacts one of the stops 1162. Preferably, each tab has a thickness that is slightly less than the width of a channel 1170.

It should be noted that as the user rotated the body portion, the teeth 1214 in the lens contacted, and rode over, the push button's teeth 1210 due to the angling of teeth 1210 and 1214. As one set of teeth ride over the other set of teeth, a clicking sound will be emitted. Once the tabs 1211 hit the stops 1162, the same angling of the teeth 1210 enable said teeth 1210 and teeth 1214 to lock together whereby body portion 1062 cannot move in a reverse direction in which the tabs 1211 move away from the stops 1162. At this point, the body portion 1062 is locked onto the hub portion 1060.

Removal of body portion 1062 from hub portion 1060 is extremely quick and easy. A user merely presses in the push button 1080, compressing the spring 1074, until the push button has moved sufficiently inwards whereby it's teeth 1210 disengage from the teeth 1214 of the lens. Once disengaged, a user is free to rotate the body portion in a direction whereby the tabs 1211 move away from the stops 1162. The body portion is rotated until the tabs 1211 are centered in the cut-outs 1195 and then the body portion is free to be removed from the hub portion.

Once fully assembled, the yo-yo operates in the normal manner of an auto-return yo-yo. When the yo-yo is rotating at a high rate of speed, centrifugal/centripetal force acts on the weights 1070 and causes the arms 1068 to move away from the spool 1012. As the arms move away from the spool, the teeth 1183 of the arms no longer contact the spool's o-ring 1032. At that point, the spool may freely rotate on the axle pin whereby the yo-yo will be able to sleep at the end of the tether. When the yo-yo slows down, the force applied by the compressed springs 1066 overcomes the radially-directed centrifugal/centripetal force and acts to push the arms 1068 inwardly, where the arms' teeth 1183 once again engage the o-ring 1032. Once a sufficiently strong engagement occurs, the arms lock the spool 1012 to the hub 1064. This effectively locks the tether's loop 1018 to the rotating side portions and thereby causes the tether to wind about the spool and the yo-yo to return to the user's hand.

Figure 20:
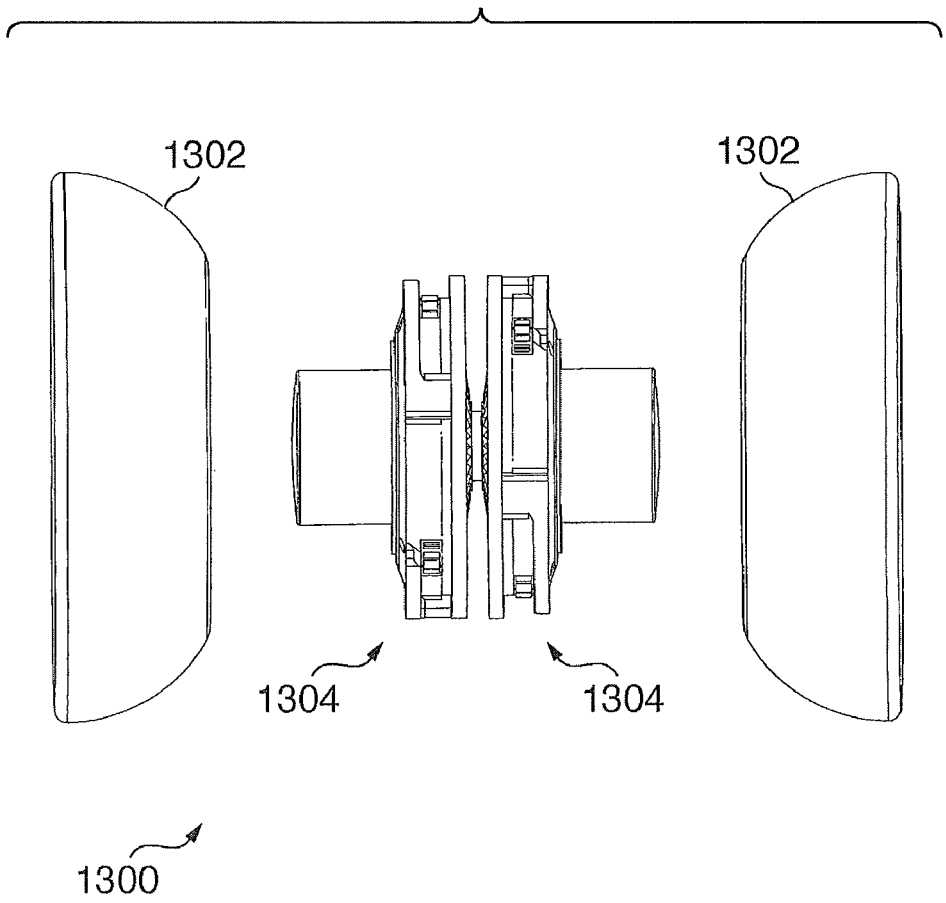
FIG. 20 is a front view of a yo-yo in accordance with a variation of the second embodiment of the invention wherein the body portions are shown disconnected from the hub portions.

It should be noted that other body portions that have different shapes and/or weights and/or other characteristics may be substituted for body portions 1036 and 1062. FIG. 20 shows a yo-yo 1300 according to a variation of the second embodiment of the invention in which the yo-yo's two identical body portions 1302 have been removed from its two hub portions 1304. Said hub portions are preferably identical to hub portion 1034 of yo-yo 1001. Therefore, one could employ the body portions 1302 in lieu of the body portions 1036 and 1062 in yo-yo 1001. It should be noted that other hub portions that have different shapes and/or weights and/or internal components such as lights or sound emitters and/or other characteristics may be substituted for the hub portions in yo-yos 1001 and 1300.

It should also be noted that the system for locking the body portion to the hub portion in side portion 1004, wherein teeth in the lens engage teeth located on the push button, can be used in side portion 1002 in lieu of said side portion's use of spur gears and a main gear. Alternatively, the system of locking the body portion to the hub portion employed in side portion 1004 can be used in side portion 1002 in place of its previously described system. In addition, while the tabs are shown as a part of the body portion and the channels are incorporated into the hub portion, the location of these elements can be reversed. The tabs can be located in the periphery of the hub portion and the channels can be located in the interior bore of the body portion, with a locking apparatus per side portion 1004 used to positionally lock the body portion relative to the hub portion.

Furthermore, a channel as used herein may also be considered a groove or slot. In addition, a cut-out as used herein may also be considered an opening.

The preferred embodiments of the invention disclosed herein have been discussed for the purpose of familiarizing the reader with the novel aspects of the invention. Although preferred embodiments of the invention have been shown and described, many changes, modifications and substitutions may be made by one having ordinary skill in the art without necessarily departing from the spirit and scope of the invention as described in the following claims.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A yo-yo comprising:

first and second side portions secured together in a spaced-apart relation by an axle structure;

a tether secured to a portion of said axle structure;

wherein said first side portion comprises first and second primary portions;

wherein one of said primary portions includes at least one tab and wherein the other of said primary portions features possesses a channel and a side channel connected to the channel on a concentric circle, the channel and the side channel being adapted to inwardly receive said tab;

wherein said first primary portion is releasably secured to said second primary portion in a manner wherein when a user is securing said first primary portion to said second primary portion, the user locates said tab adjacent said channel and then rotates said first primary portion relative to said second primary portion to thereby cause said tab to move into said side channel, and wherein once said tab is fully received within said side channel, a locking apparatus operatively connected to one of said primary portions is releasably engaged and functions to prevent a rotation of said first primary portion relative to said second primary portion that would allow said tab to exit said side channel; and wherein said locking apparatus comprises a gear having a plurality of teeth, a push button operatively connected to said gear, and a plurality of teeth located on said tab, wherein said tab teeth engage said gear teeth, and wherein said gear is either rotatable or fixed depending on the position of said push button.

2. The yo-yo of claim 1 wherein said second side portion is substantially different from said first side portion.

3. The yo-yo of claim 1 wherein a user can change the shape of said first side portion by removing said first primary portion and in its place installing a first primary portion that is shaped differently than the removed first primary portion.

4. The yo-yo of claim 1 wherein said gear is a spur gear and wherein a rotatable main gear has a first set of teeth that engage said spur gear and a second set of teeth that engage a set of teeth located on said push button, wherein said push button is spring biased by a spring and movably secured to either said first primary portion or said second primary portion in a manner wherein pressing in said push button causes the push button teeth to disengage from the teeth of the main gear whereby said main gear can then rotate so that said first primary portion can then rotate in a direction that allows said tab to be removed from said channel.

5. A yo-yo comprising:

first and second side portions secured together in a spaced-apart relation by an axle structure;

a tether secured to a portion of said axle structure;

wherein said first side portion comprises first and second primary portions;

wherein one of said primary portions includes at least one tab and wherein the other of said primary portions possesses a channel and a side channel connected to the channel on a concentric circle, the channel and the side channel being adapted to inwardly receive said tab;

wherein said first primary portion is releasably secured to said second primary portion in a manner wherein when a user is securing said first primary portion to said second primary portion, the user locates said tab adjacent said channel and then rotates said first primary portion relative to said second primary portion to thereby cause said tab to move into said side channel and wherein once said tab is fully received within said side channel, a locking apparatus operatively connected to one of said primary portions is releasably engaged and functions to prevent a rotation of said first primary portion relative to said second primary portion that would allow said tab to exit said side channel; and wherein said locking apparatus comprises a push button that can interact with a portion of one of said primary portions wherein said push button has a plurality of teeth, is operatively connected to the other of said primary portions and is spring-biased by a spring, wherein said one of primary portions has a plurality of teeth that can engage said teeth of said push button when said push button is in a first position, and wherein when said push button is moved to a second position, the push button teeth disengage from the teeth of said one of the primary portions so that said one of the primary portions can then be rotated in a direction that allows said tab portion to be removed from said channel portion.

6. The yo-yo according to claim 1, wherein said first primary portion is a hub portion and said second primary portion is a body portion.

7. The yo-yo according to claim 5, wherein said first primary portion is a hub portion and said second primary portion is a body portion.

8. The yo-yo according to claim 1, wherein a portion of the side channel is circumferentially offset from the channel.

9. The yo-yo according to claim 1, the side channel possessing a first end portion and a second end portion, the first end portion opening directly into the channel, and the second end portion being circumferentially offset from the channel so that the second end portion does not open directly into the channel.

10. The yo-yo according to claim 5, wherein a portion of the side channel is circumferentially offset from the channel.

11. The yo-yo according to claim 5, the side channel possessing a first end portion and a second end portion, the first end portion opening directly into the channel, and the second end portion being circumferentially offset from the channel so that the second end portion does not open directly into the channel.

* * * * *